US011542718B2

(12) United States Patent
Lindbo et al.

(10) Patent No.: US 11,542,718 B2
(45) Date of Patent: Jan. 3, 2023

(54) ROBOTIC PARKING DEVICE AND HANDLING METHOD

(71) Applicant: Ocado Innovation Limited, Hatfield (GB)

(72) Inventors: Lars Sverker Ture Lindbo, Hatfield (GB); Matthew Whelan, Hatfield (GB); Martin Roland Akerblad, Stockholm (SE); Carl Edvin Von Otter, Stockholm (SE); William Bjorn David Bruce, Stockholm (SE)

(73) Assignee: OCADO INNOVATION LIMITED, Hatfield (GB)

( * ) Notice: Subject to any disclaimer, the term of this patent is extended or adjusted under 35 U.S.C. 154(b) by 0 days.

(21) Appl. No.: 16/762,779

(22) PCT Filed: Dec. 11, 2018

(86) PCT No.: PCT/EP2018/084417
§ 371 (c)(1),
(2) Date: May 8, 2020

(87) PCT Pub. No.: WO2016/115556
PCT Pub. Date: Jun. 20, 2016

(65) Prior Publication Data

US 2021/0363770 A1 Nov. 25, 2021

(30) Foreign Application Priority Data

Dec. 11, 2017 (GB) ..... 1720633

(51) Int. Cl.
*E04H 6/22* (2006.01)
*E04H 6/18* (2006.01)

(52) U.S. Cl.
CPC ..... *E04H 6/22* (2013.01); *E04H 6/181* (2013.01)

(58) Field of Classification Search
CPC ..... E04H 6/22; E04H 6/225; E04H 6/181
See application file for complete search history.

(56) References Cited

U.S. PATENT DOCUMENTS 3,390,791 A 7/1968 Baldwin et al.
4,971,506 A * 11/1990 Givati ..... E04H 6/182 414/256

(Continued)

FOREIGN PATENT DOCUMENTS

CN 105041026 A 11/2015
CN 206071166 U 4/2017

(Continued)

OTHER PUBLICATIONS

Office Action (Notice of Reasons for Refusal) dated Jun. 29, 2021, by the Japanese Patent Office in corresponding Japanese Patent Application No. 2020-550916 and an English Translation of the Office Action. (4 pages).

(Continued)

*Primary Examiner* — Kaitlin S Joerger
(74) *Attorney, Agent, or Firm* — Buchanan Ingersoll & Rooney PC

(57) ABSTRACT

An alignment mechanism for a robotic parking device is described. The device includes a number of stacks of containers, the stacks being positioned within a frame structure having uprights and a horizontal grid disposed above the stacks, the grid having substantially perpendicular rails on which load handling devices can run. Cars or vehicles are positioned in containers that are moved in to and out of the stacks by the robotic handling devices. The cars are put in to the grid at entry points that can be positioned at points under the stacks. The alignment mechanism includes a series of belts moveable relative to each other and relative to the container, the belts acting to align a long axis of a vehicle (Continued)

with a long axis of the container in to which the vehicle is to be placed.

3 Claims, 19 Drawing Sheets

(56) References Cited

U.S. PATENT DOCUMENTS

| | | | | |
|---|---|---|---|---|
| 5,118,239 | A * | 6/1992 | Morioka | E04H 6/282 414/235 |
| 5,331,781 | A * | 7/1994 | Gilbert | E04H 6/225 414/253 |
| 10,196,209 | B2 | 2/2019 | Lindbo et al. | |
| 10,364,098 | B2 | 7/2019 | Lindbo et al. | |
| 10,538,388 | B2 | 1/2020 | Clarke et al. | |
| 10,549,914 | B2 | 2/2020 | Clarke et al. | |
| 2005/0144194 | A1* | 6/2005 | Lopez | E04H 6/422 |
| 2010/0014950 | A1* | 1/2010 | Blackmore | E04H 6/065 414/229 |
| 2010/0034626 | A1 | 2/2010 | Reiniger et al. | |
| 2013/0097960 | A1* | 4/2013 | Zhu | E04B 1/19 52/653.1 |
| 2013/0322993 | A1 | 12/2013 | Farid et al. | |
| 2018/0035625 | A1 | 2/2018 | Lindbo et al. | |
| 2018/0037411 | A1 | 2/2018 | Lindbo et al. | |
| 2018/0044110 | A1 | 2/2018 | Clarke et al. | |
| 2018/0044111 | A1 | 2/2018 | Clarke et al. | |
| 2018/0050869 | A1 | 2/2018 | Lindbo et al. | |
| 2018/0051459 | A1 | 2/2018 | Clarke et al. | |
| 2018/0086559 | A1 | 3/2018 | Lindbo et al. | |
| 2018/0093828 | A1 | 4/2018 | Lindbo et al. | |
| 2018/0237221 | A1 | 8/2018 | Lindbo et al. | |
| 2019/0241362 | A1 | 8/2019 | Lindbo et al. | |

FOREIGN PATENT DOCUMENTS

| | | | |
|---|---|---|---|
| DE | 10151916 | A1 | 5/2003 |
| EP | 0340673 | A1 | 11/1989 |
| EP | 0740034 | A1 | 10/1996 |
| EP | 2663703 | B1 | 3/2014 |
| GB | 2540838 | A | 2/2017 |
| JP | H04115067 | A | 4/1992 |
| JP | H05272255 | A | 10/1993 |
| JP | 2001-152692 | A | 6/2001 |
| JP | 2002-104788 | A | 4/2002 |
| KR | 20100006697 | U | 7/2010 |
| KR | 20100123298 | A | 11/2010 |
| WO | 9110794 | A1 | 7/1991 |

OTHER PUBLICATIONS

Office Action dated Jul. 13, 2021, by the Canadian Intellectual Property Office in corresponding Canadian Patent Application No. 3,085,073. (5 pages).

Office Action (Examination Report No. 1) dated Jan. 19, 2021, by the Australian Patent Office in corresponding Australian Patent Application No. 2018385444. (5 pages).

Office Action (Notice of Second Review Opinion) dated Aug. 18, 2021, by the Chinese Patent Office in corresponding Chinese Patent Application No. 201880079779.7, and an English Translation of the Office Action. (11 pages).

International Search Report (PCT/ISA/210) dated Apr. 12, 2019, by the European Patent Office as the International Searching Authority for International Application No. PCT/EP2018/084417.

Written Opinion (PCT/ISA/237) dated Apr. 12, 2019, by the European Patent Office as the International Searching Authority for International Application No. PCT/EP2018/084417.

Office Action dated Mar. 5, 2021, by the Chinese Patent Office in corresponding Chinese Patent Application No. 201880079779.7, and an English Translation of the Office Action. (14 pages).

Office Action (Communication) dated Oct. 4, 2021, by the European Patent Office in corresponding European Patent Application No. 18830408.3. (5 pages).

Office Action dated Nov. 2, 2021, by the Great Britain Patent Office in corresponding Great Britain Patent Application No. GB2102952.5. (5 pages).

Office Action (Notification of Reason for Refusal) dated Nov. 29, 2021, by the Korean Patent Office in corresponding Korean Patent Application No. 10-2020-7018413, and an English Translation of the Office Action. (7 pages).

Office Action dated Jan. 26, 2022, by the Canadian Patent Office in corresponding Canadian Patent Application No. 3,085,073. (3 pages).

Office Action (Request for the Submission of an Opinion) dated Jun. 28, 2022, 2022, by the Korean Patent Office in corresponding Korean Patent Application No. 10-2020-7018413, and an English Translation of the Office Action. (6 pages).

* cited by examiner

ROBOTIC PARKING DEVICE AND HANDLING METHOD

The present invention relates to a robotic parking system device and method. More specifically but not exclusively, it relates to how a vehicle arriving to be parked in such a robotic parking system device and method may be aligned for presentation and onward retrieval by the robotic system.

This application relies on the technology disclosed in the applicant's pending published application number GB 2,540,838 A1 herein incorporated in its entirety by reference.

There are over one billion cars in the world and most of them are parked at any given point in time. In many cities and other locations, car parking requires a substantial percentage of the available land, which has led to the evolution of the multi-storey car park. Due to the need to random access to all of the cars, restrictions imposed by varying sizes of vehicles, structural needs of the buildings and the need for drivers and passengers to comfortably access their vehicles, such car parks do not fully utilise the available volume for parked cars. In fact, only around 10% of the volume of a typical multi storey car park is actually filled with the volume of cars. The present invention seeks to increase that number to around 40%.

Methods for parking vehicles more densely using mechanical devices exist as described in patent applications EP0740034 A1 and DE10151916 A1 or patents U.S. Pat. No. 3,390,791 and EP2663703 B1. The Otto Wöhr Company claims to have delivered over 400,000 mechanised parking locations globally over the years. Such systems allow more density than a conventional multi storey garage, but have some significant drawbacks. These include cost, reliability and throughput capacity. These factors have therefore made them difficult to justify in many situations. The present invention uses a completely different principle to address these drawbacks.

GB2540838 discloses a parking system in which vehicles are located in storage boxes or cages, the boxes or cages being stacked in a high density manner beneath a grid structure of tracks or rails on which load handling devices operate. The load handlers can move in an X-Y direction on the tracks or rails and be moved so as to be above the top box or cage of any stack in the system. The load handler comprises a lifting and gripping device that can be lowered to interact with one of the boxes or cages to lift it out of the stack and in to cavity within the load handler. The load handler can then be moved under the control of a computer utility to an output port wherein the box or cage containing the vehicle can be output from the system. In a similar manner but in reverse, vehicles in boxes or cages can be input in to the parking system.

The key benefits over the prior art of conventional multi-storey car parks is much higher density of parking. Around four times more vehicles should be achievable. Additionally, it will be much faster than driving up and down several levels of multi storeys and there would be less risk of damage to the vehicles. The key benefits over prior art mechanised car parks are cost, since the load handlers would on average be much better utilised than the cranes of the prior art systems, for any given maximum throughput capacity. Such systems are more reliable than current mechanised car parks as the system could easily be designed so that any one load handler breaking down would not prevent access to any of the vehicles. Moreover, such car parking systems would improve space utilisation, by up to a factor of two.

However, such robotic car parks require vehicles to be parked in an accurate and space efficient manner within the cage or box referred to above.

It is a problem with robotic parking systems such as those described above that the vehicle must be correctly aligned prior to entry in to the system. This may be difficult for drivers to achieve in unfamiliar circumstances. Misalignment of the vehicle prior to entry in to the robotic parking system may lead to damage to the vehicle or to the fabric of the robotic parking system.

Accordingly, there is provided an alignment mechanism for a robotic parking system the parking system comprising containers in to which vehicles are placed, the alignment mechanism comprising a vehicle carrying plate moveable from a first position adjacent a container to a second position within a container, the mechanism further comprising a transfer mechanism for transferring a vehicle from a drop off location adjacent the parking system to the plate, the transfer mechanism comprising means for moving the vehicle on to the plate, the transfer mechanism further comprising two separable moving means, the first moving means moving relative to the second moving means when the front wheels of the vehicle are positioned on the first moving means, and rear wheels of the vehicle are placed on the second moving means such that the long axis of the vehicle is moved so as to be substantially parallel to a long axis of the plate.

Preferably, the alignment mechanism further comprises conveyor means for moving the plate from the first position adjacent the container to the second position within the container, the conveyor means comprising means separate from the container and or the alignment mechanism thereby ensuring neither the container nor the plate comprise moving means.

There is further provided a method of aligning a vehicle for input in to a robotic parking system comprising vehicle holding containers, the method comprising the steps of: delivering a vehicle to a drop off location adjacent the robotic parking system, positioning the vehicle to be parked on alignment means; moving the alignment means such that a first axis of the vehicle is substantially parallel to one axis of the vehicle holding container, transferring the vehicle on to a vehicle holding plate; and moving the vehicle holding plate in a direction parallel to the first axis of the vehicle in to the vehicle holding container.

The invention will now be described with reference to the accompanying diagrammatic drawings in which.

Figure 1:
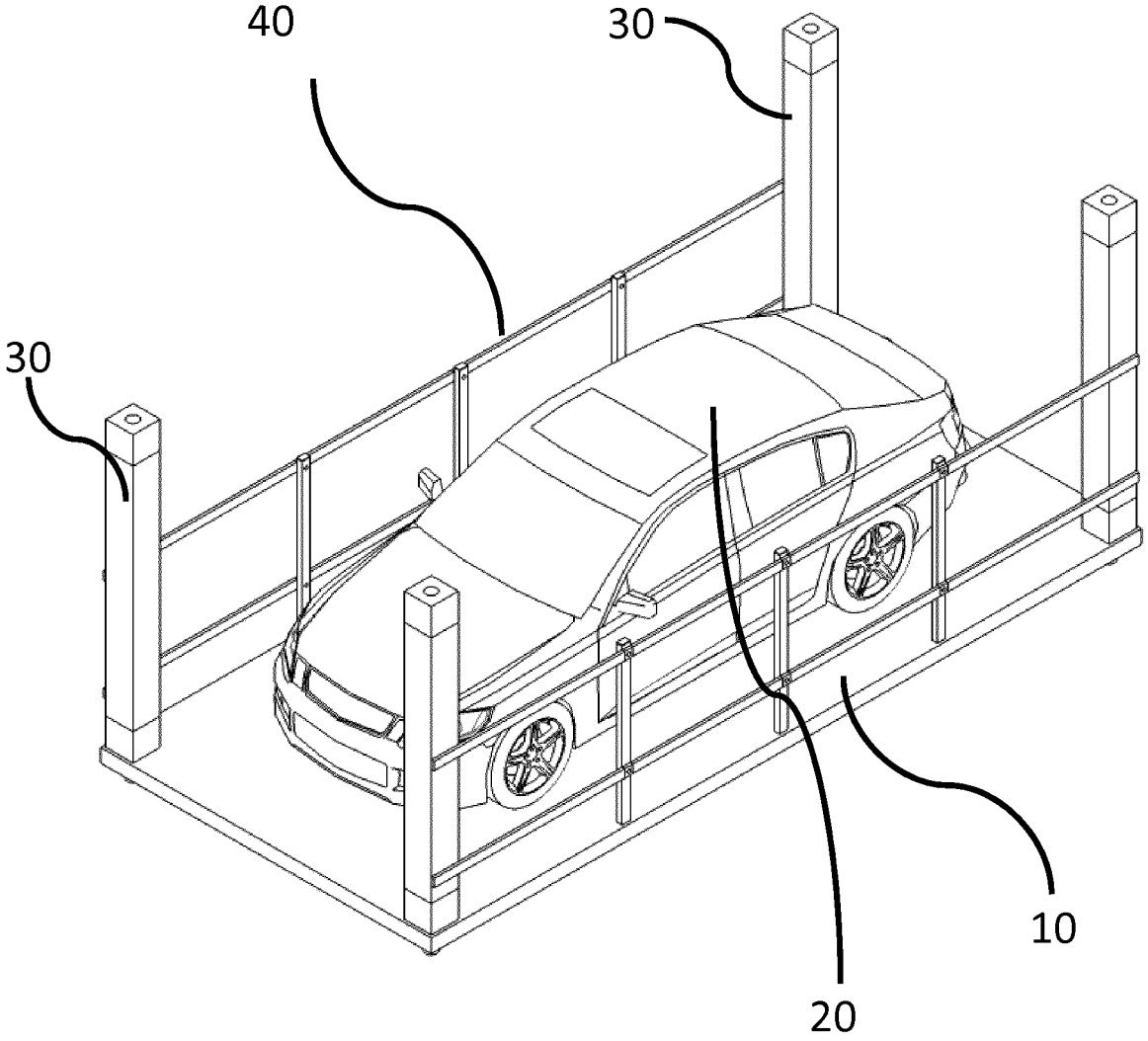
FIG. 1 shows a schematic perspective view of a container for use in a robotic car parking system, with a vehicle inside in accordance with one aspect of the invention, the container comprising four corner supports and moveable sides.
Figure 2:
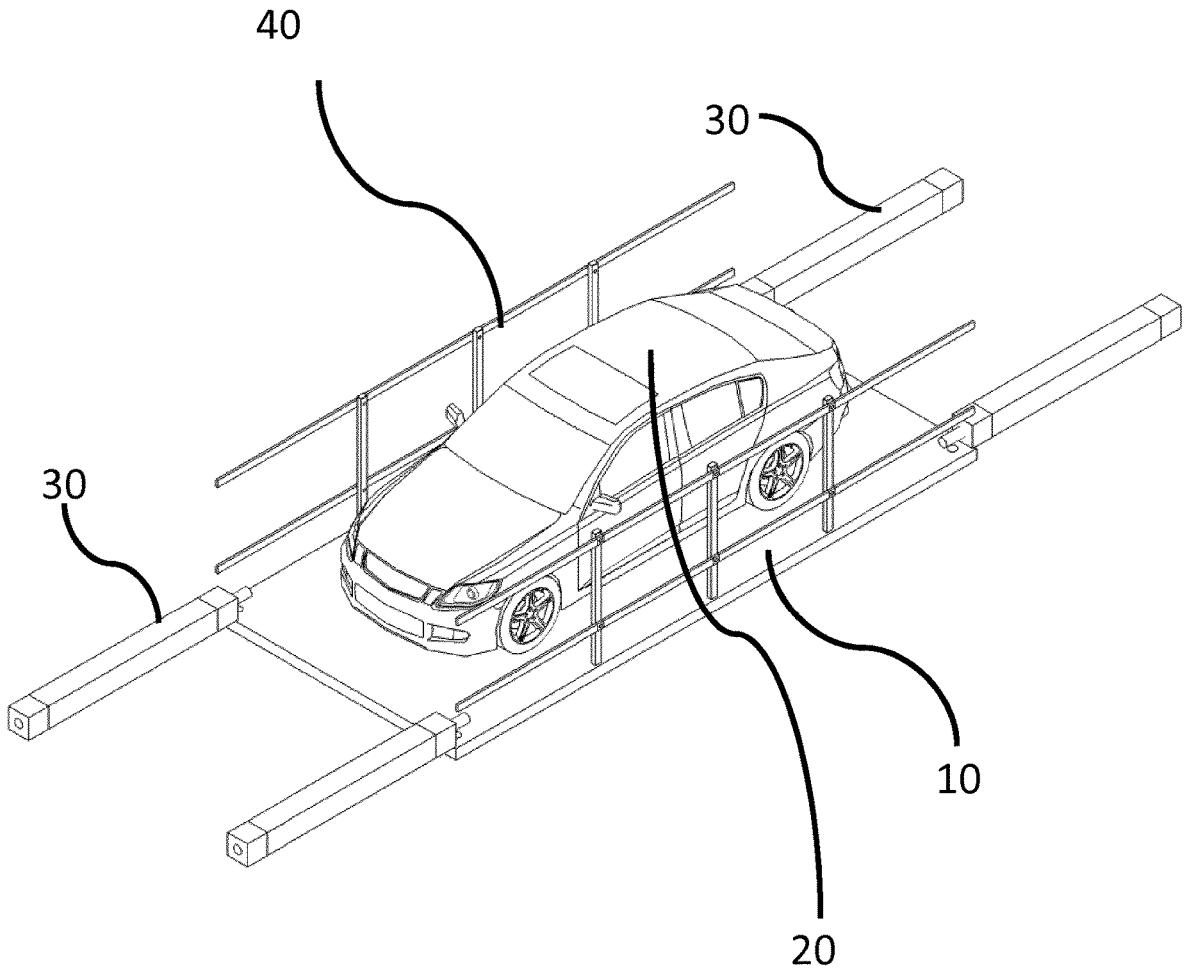
FIG. 2 shows a schematic perspective view of the container of FIG. 1 showing the corner supports folded down, the vehicle being located on a base plate attached to the corner supports.
Figure 3:
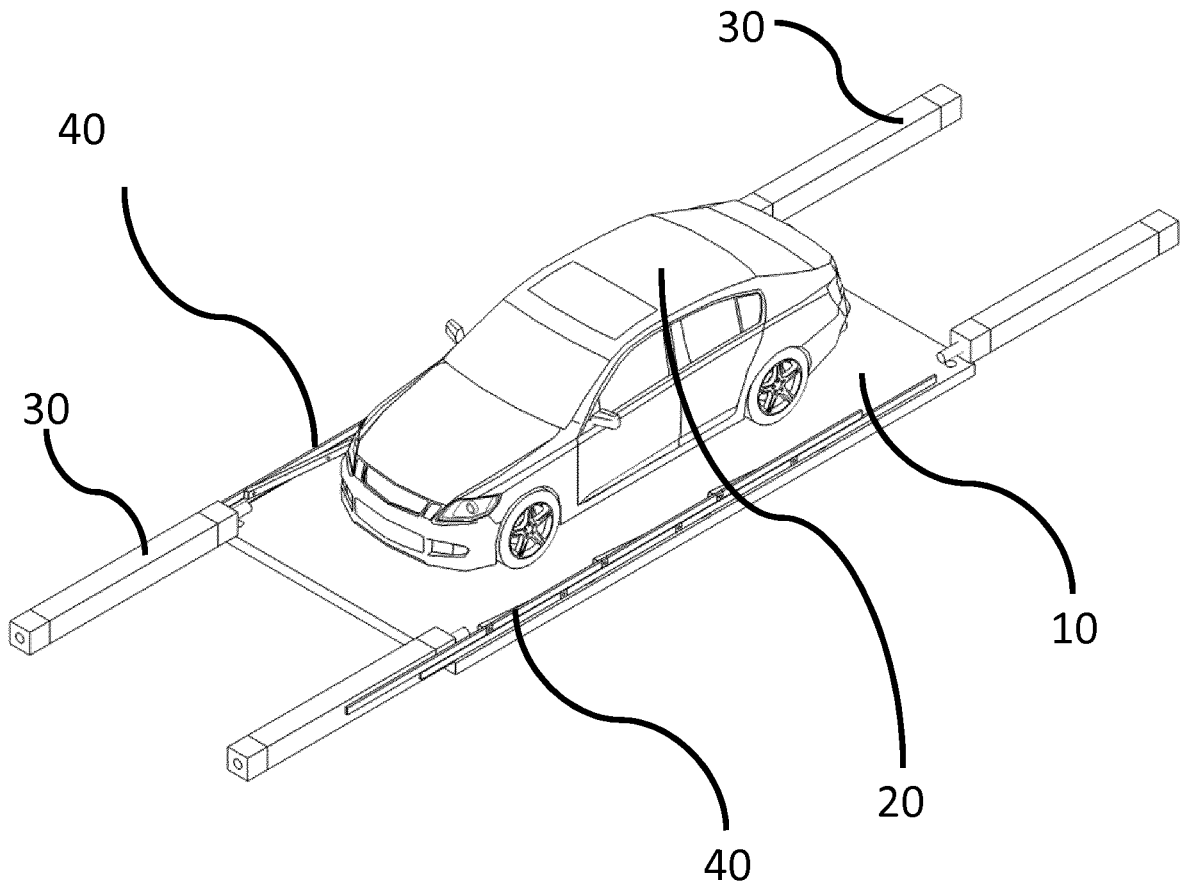
Figure 4A:
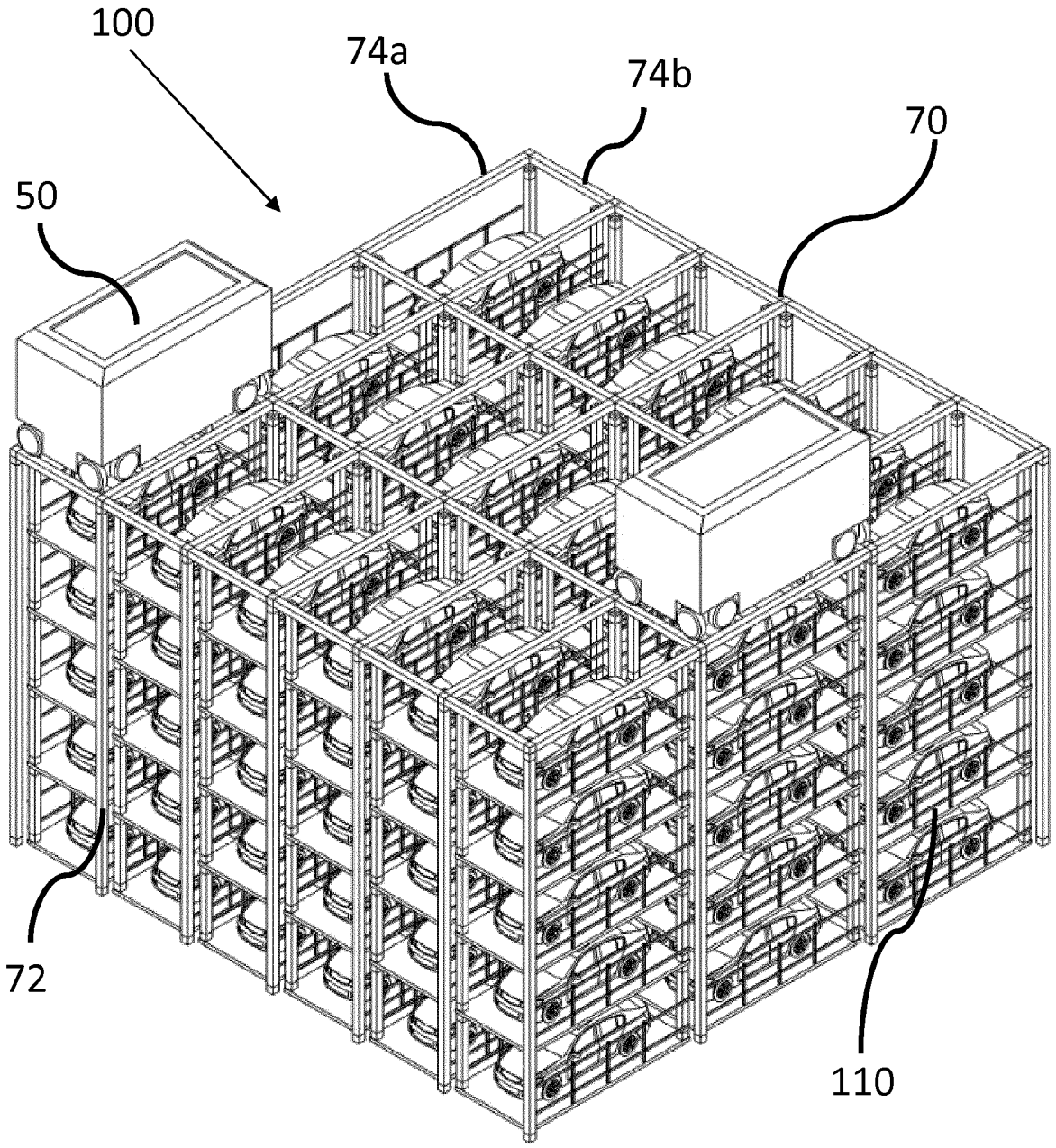
Figure 4B:
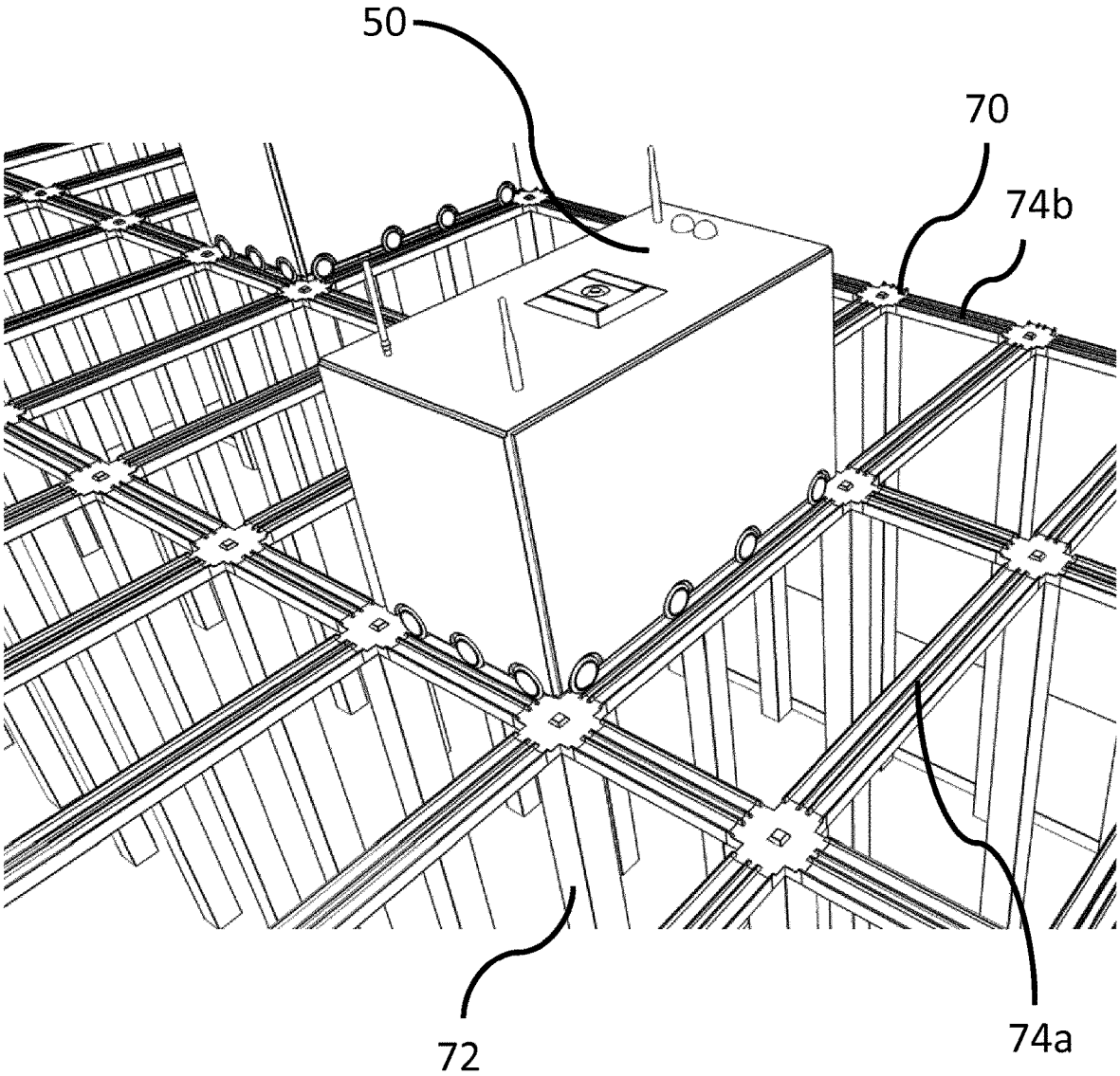

FIG. 3 shows a schematic perspective view of the container of FIGS. 1 and 2 showing the side barriers folded down to allow for access in to the vehicle, FIG. 4*a* shows a schematic perspective view of one form of robotic parking system, the system comprising a number of stacks of containers as shown in FIGS. 1 to 3, the stacks being positioned within a frame structure comprising uprights and a horizontal grid disposed above the stacks, the grid comprising substantially perpendicular rails on which load handling devices can run;

FIG. 4*b* shows a schematic perspective view of a load handling device in situ on the robotic parking system, the load handling device running on a double track system, the double track forming part of the framework of the robotic car parking system, thereby enabling load handling devices to pass each other in either the X or Y direction whilst operating on the system.

Figure 5:
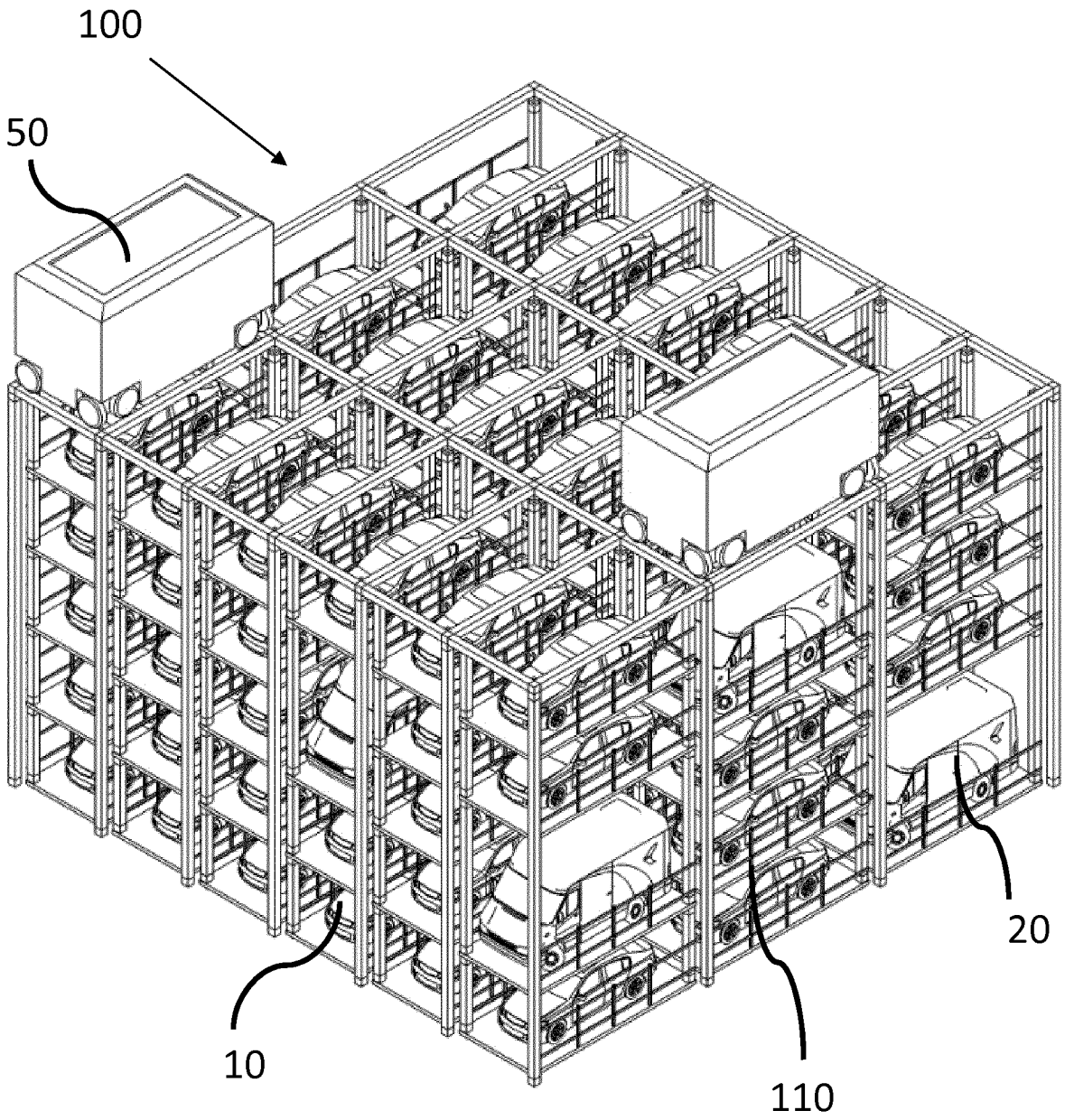
Figure 6:
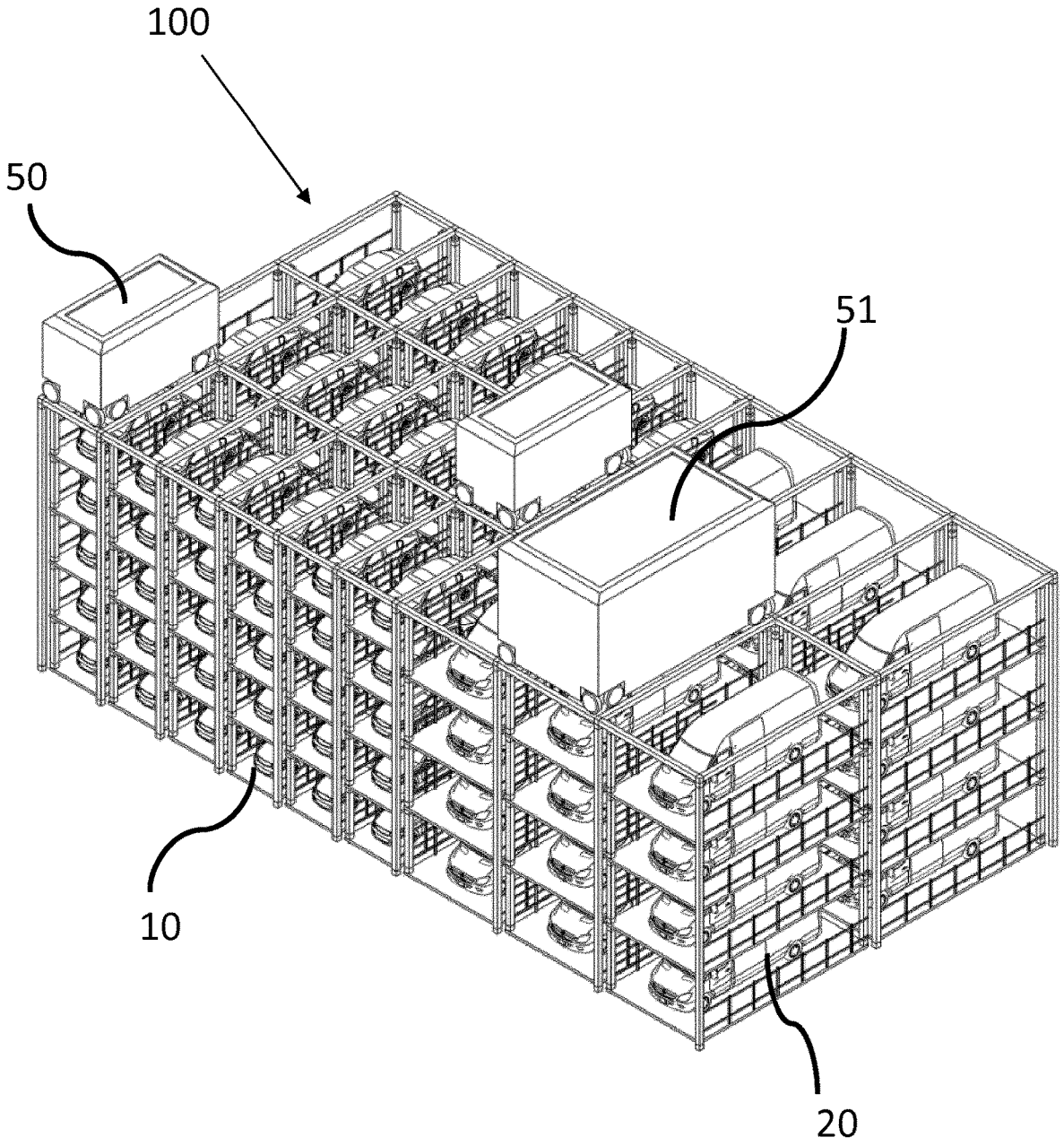
Figure 7:
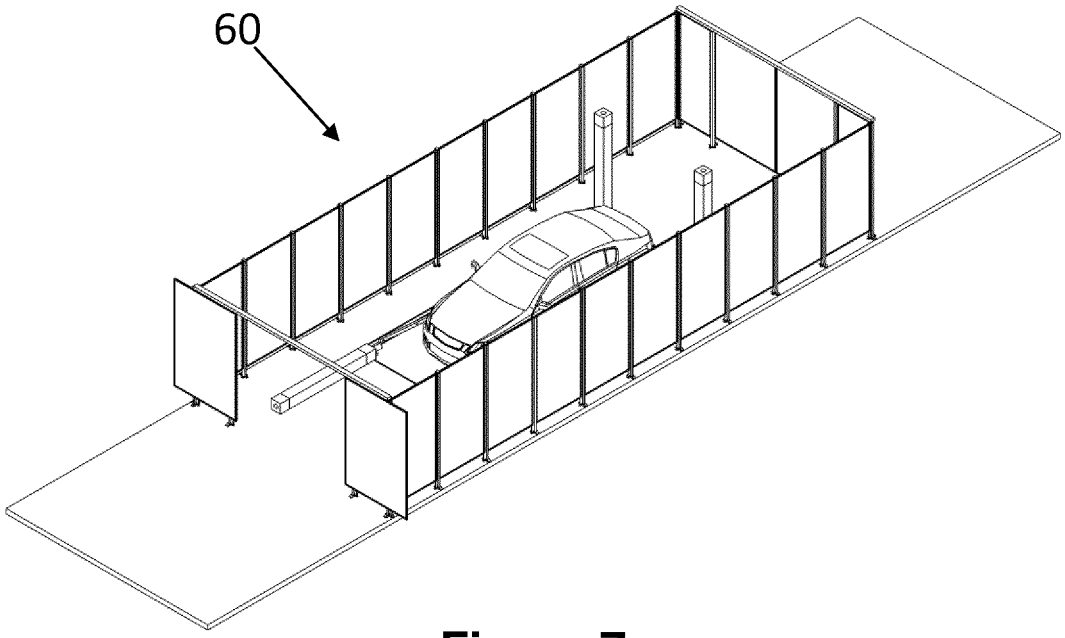
Figure 8:
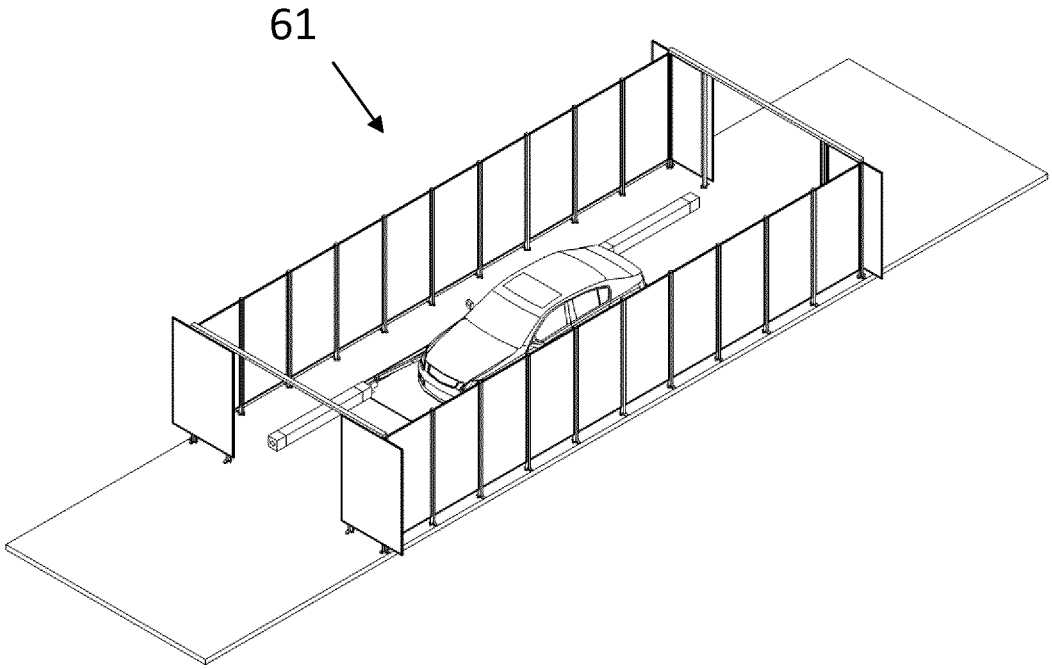
Figure 9:
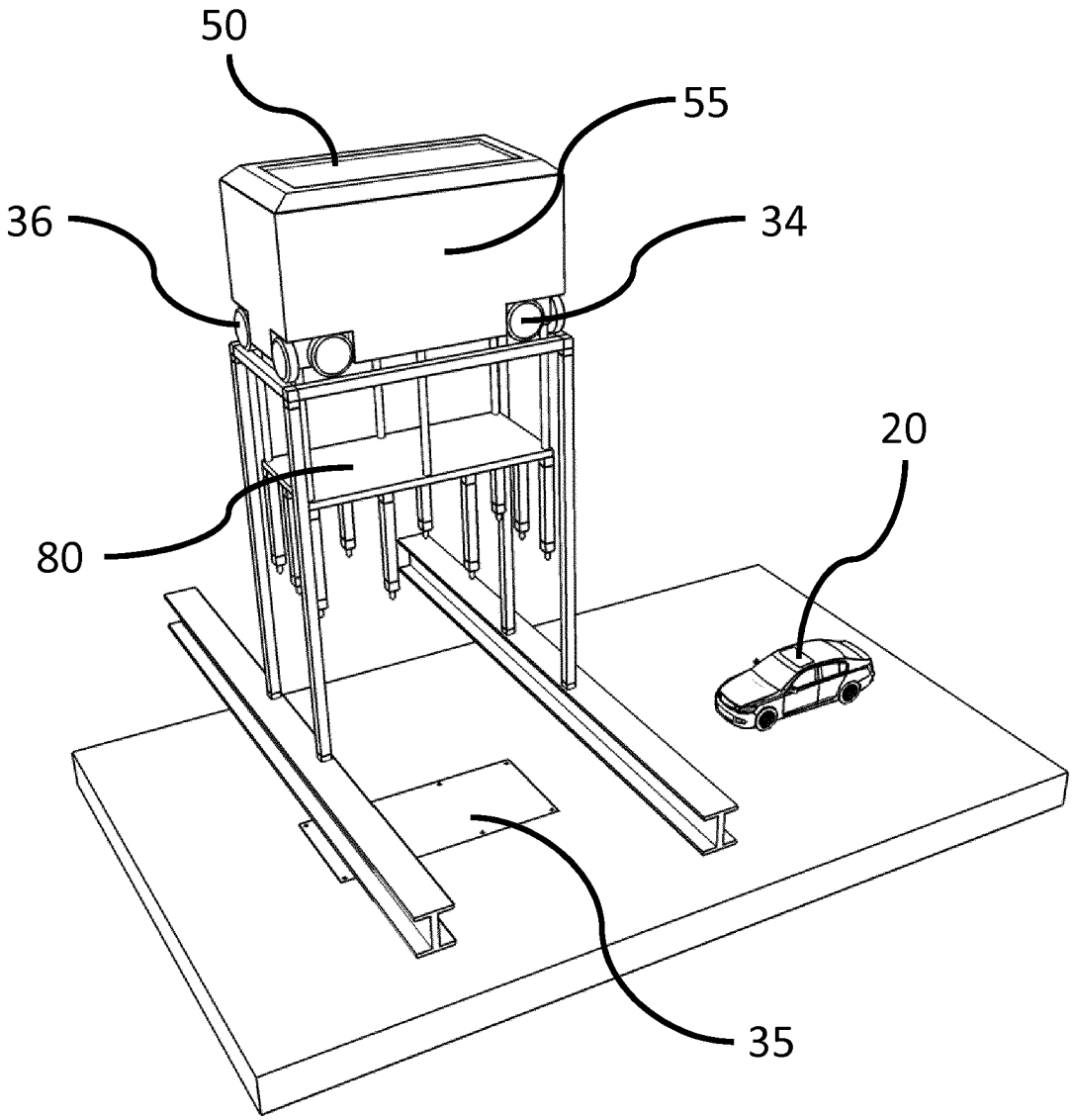
Figure 10:
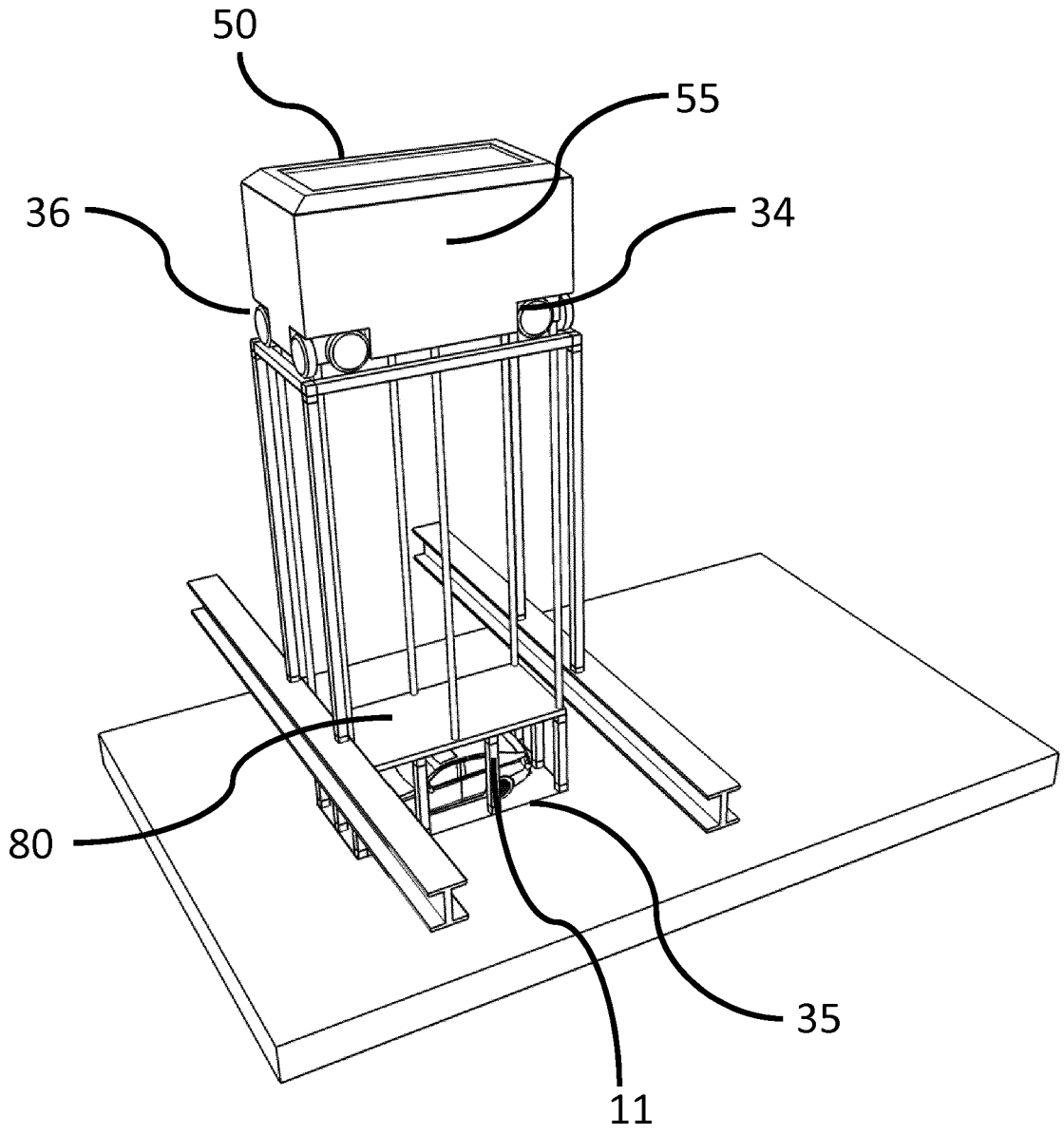
Figure 11:
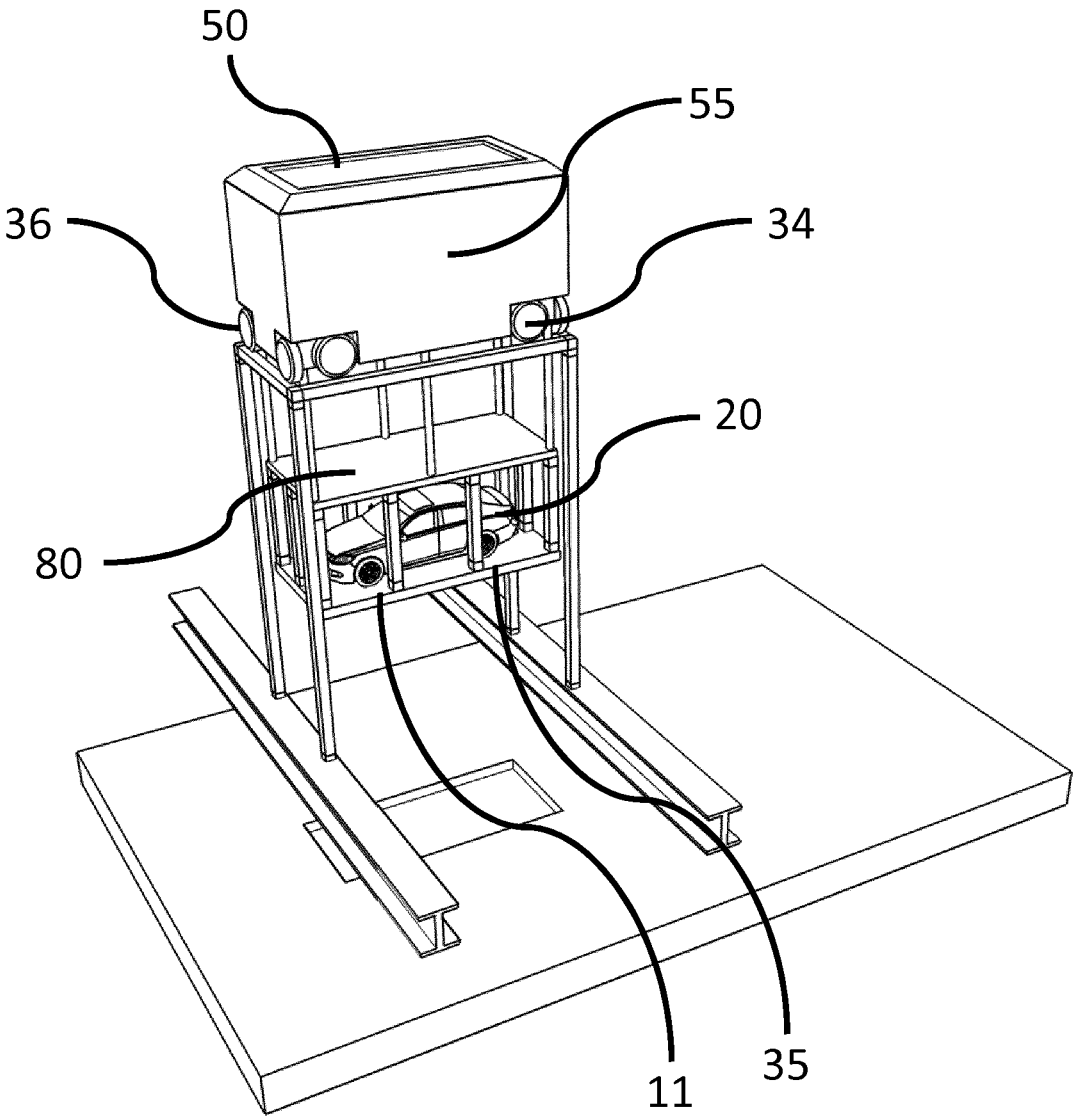
Figure 12:
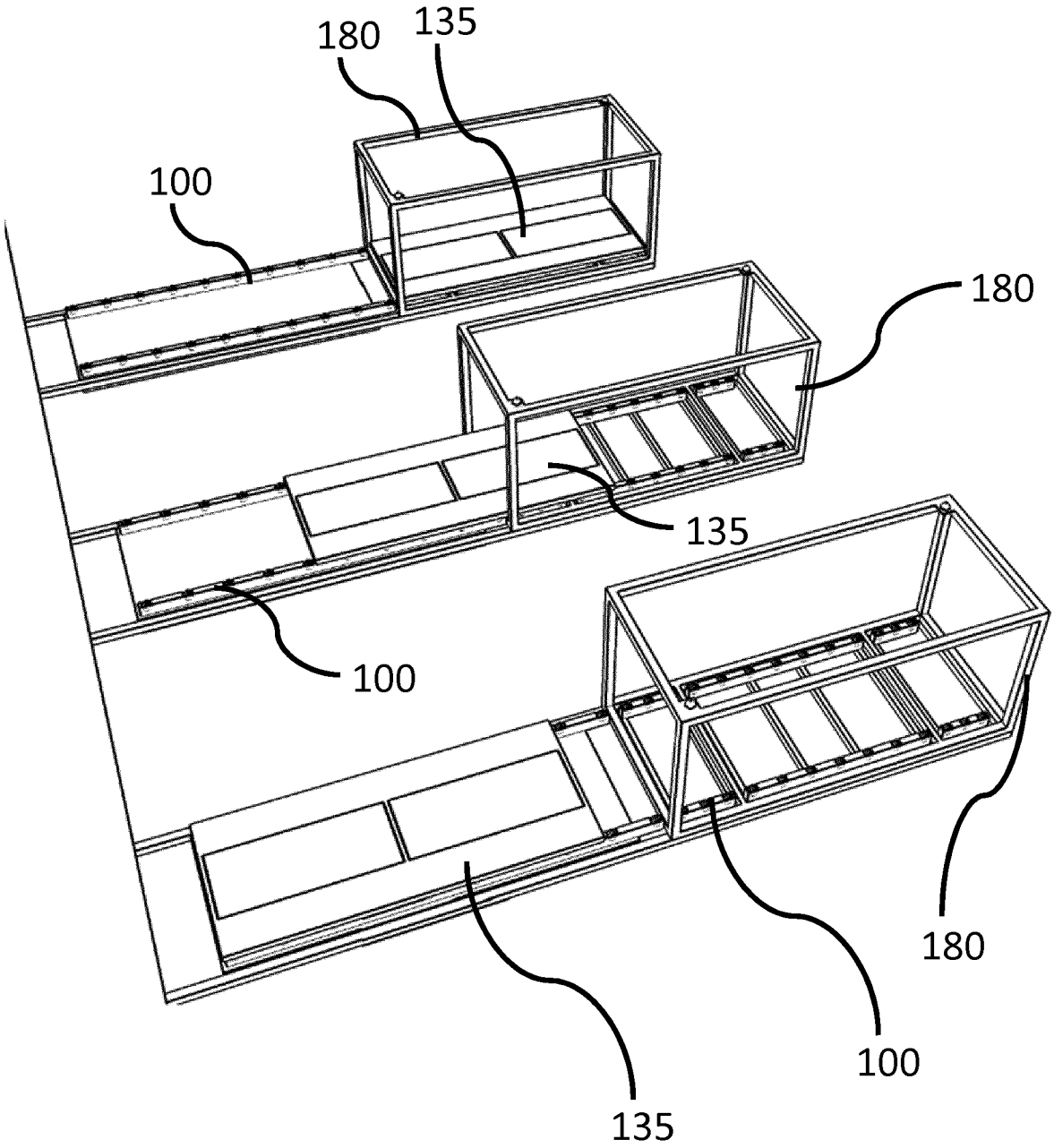
Figure 13A:
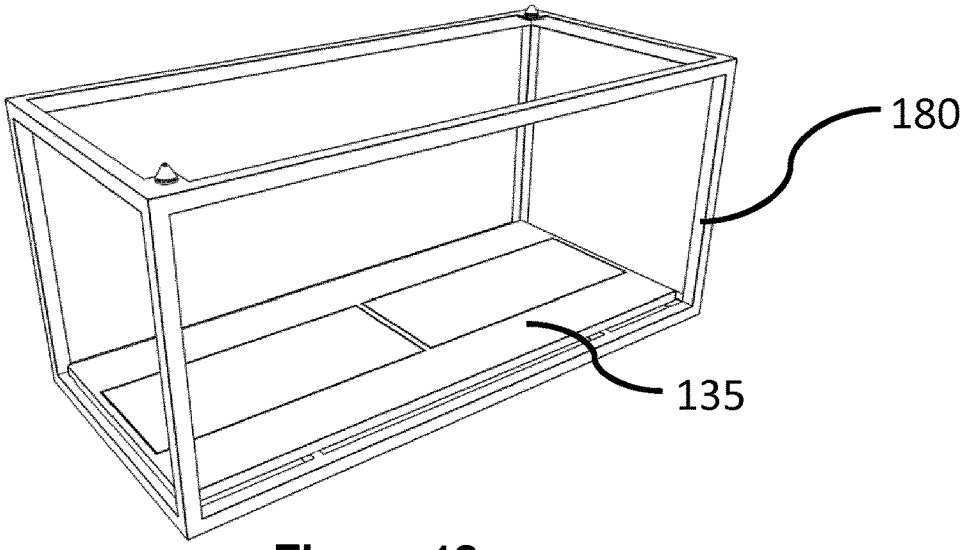
Figure 13B:
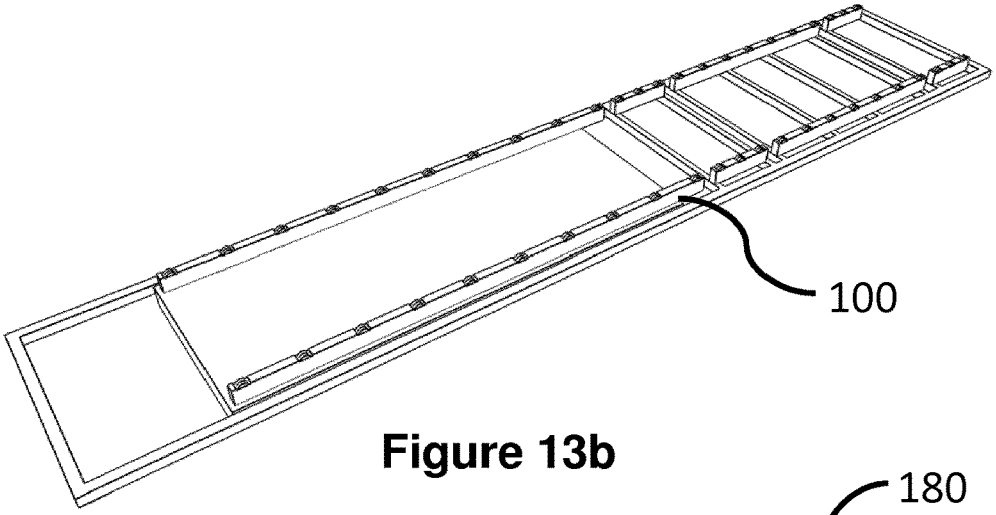
Figure 13C:
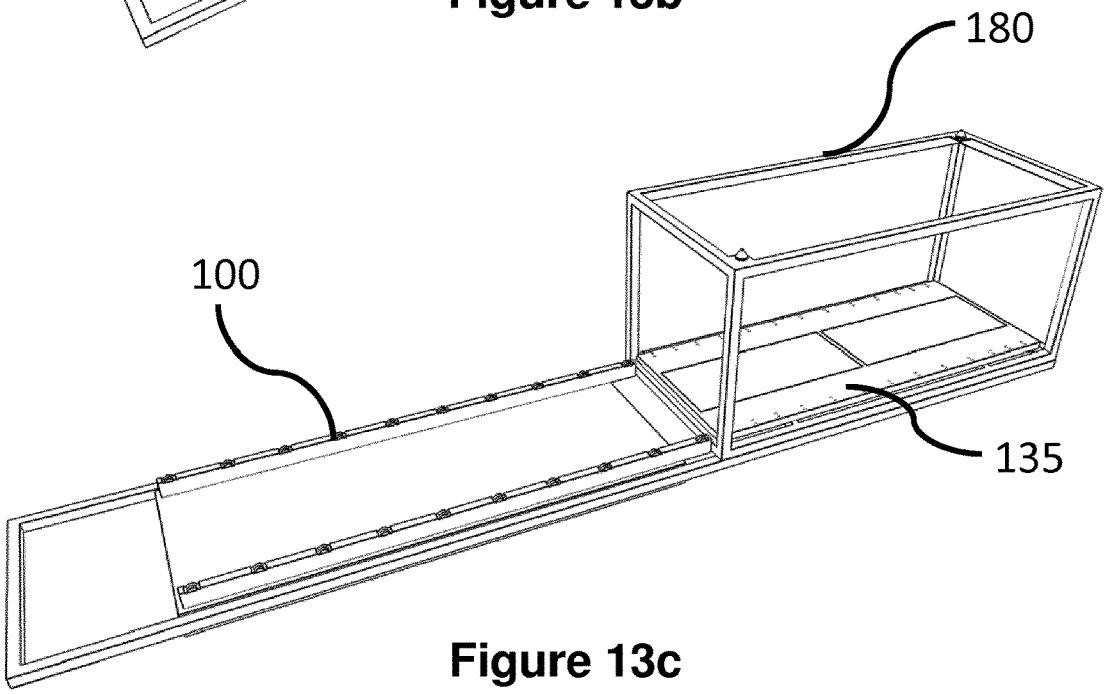
Figure 14A:
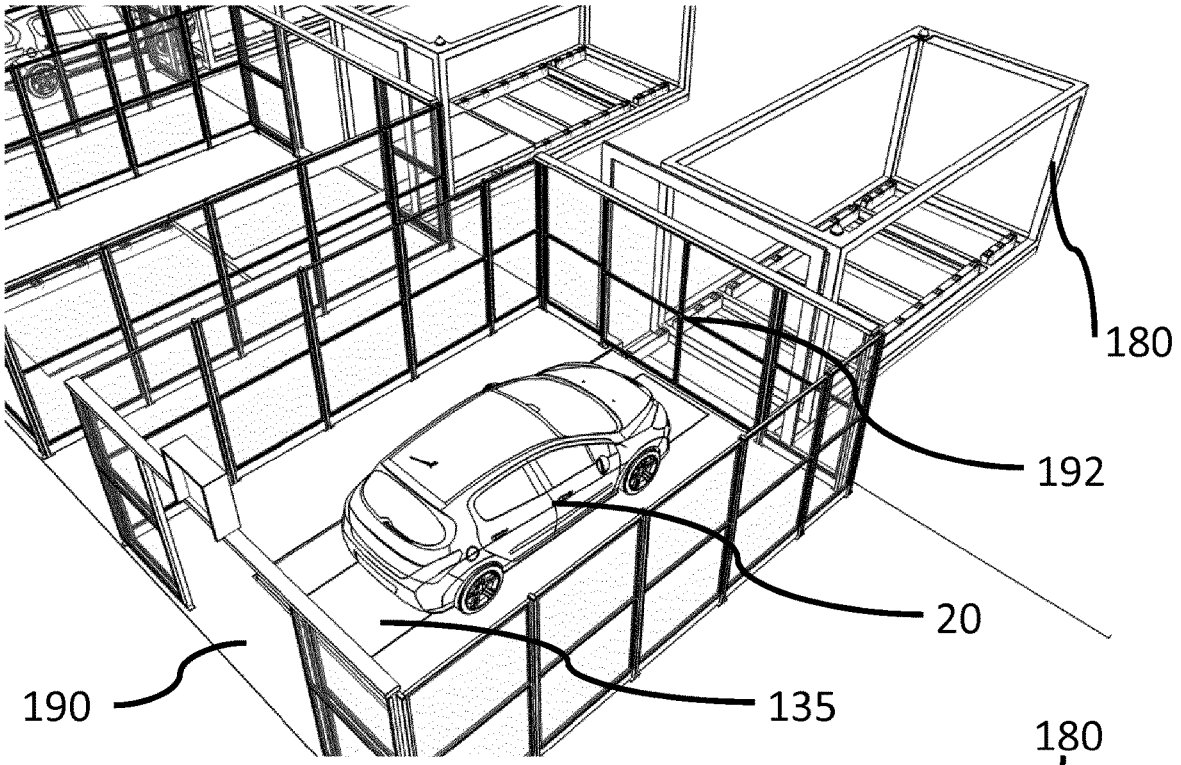
Figure 14B:
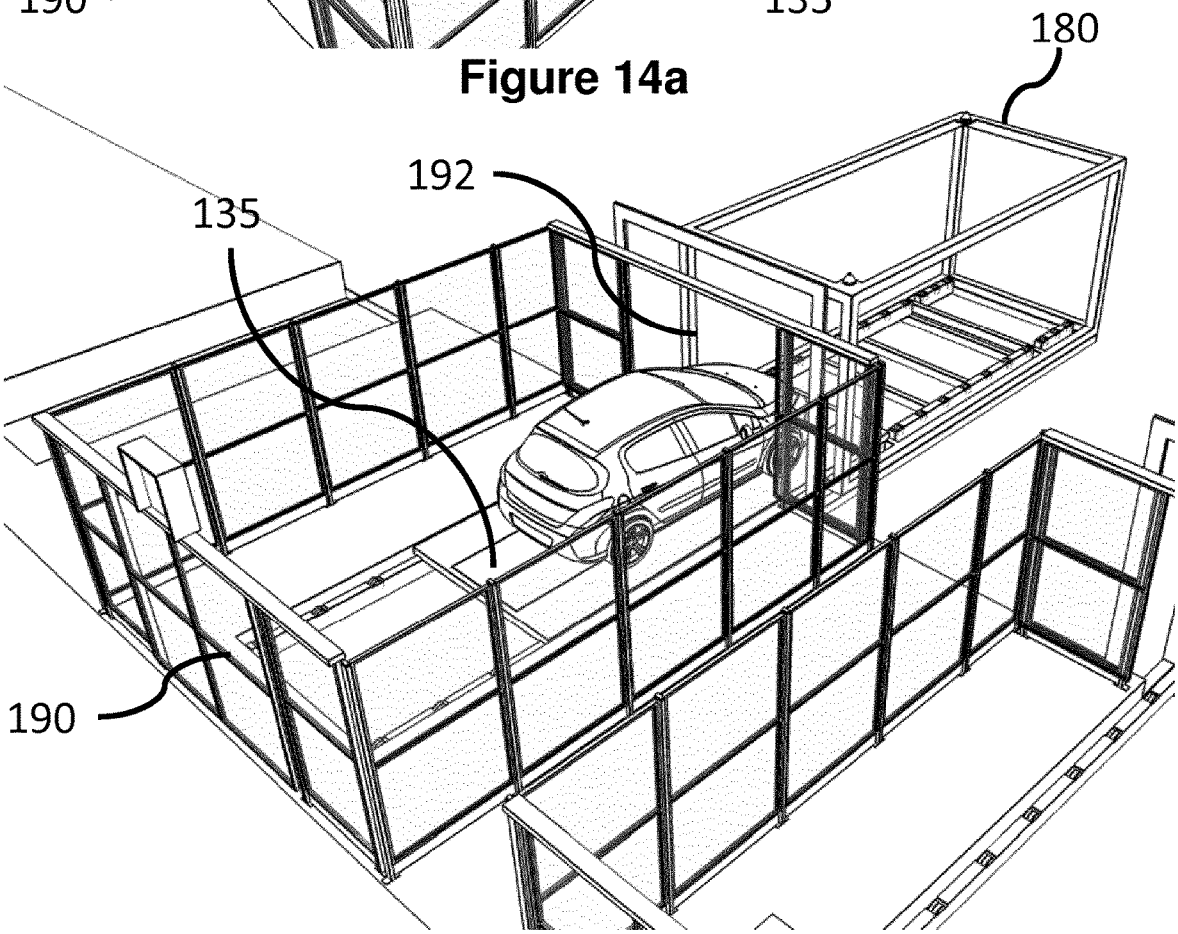
Figure 15:
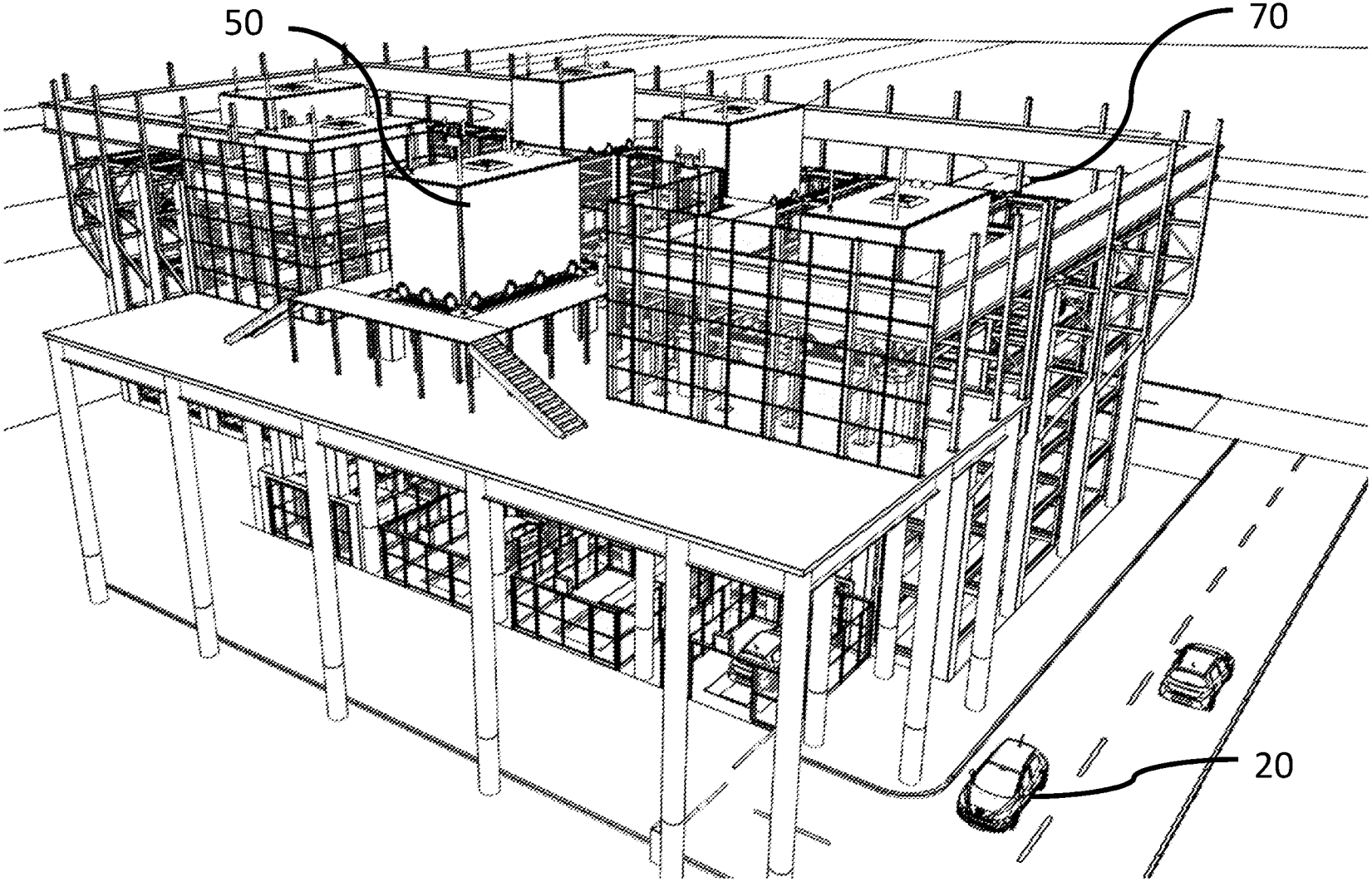
Figure 16:
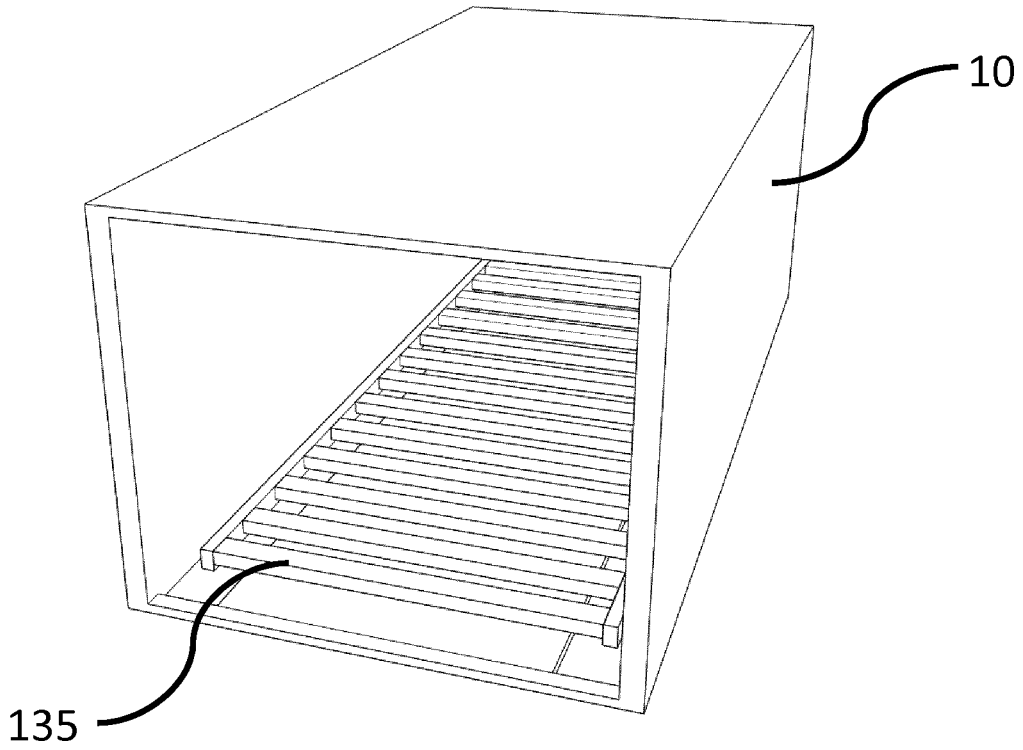
Figure 17:
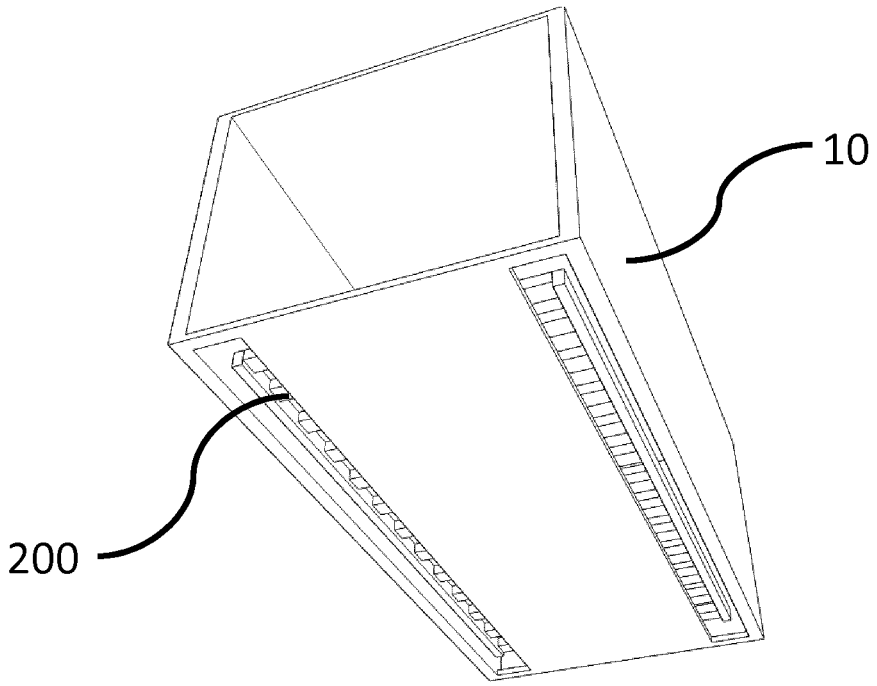
Figure 18:
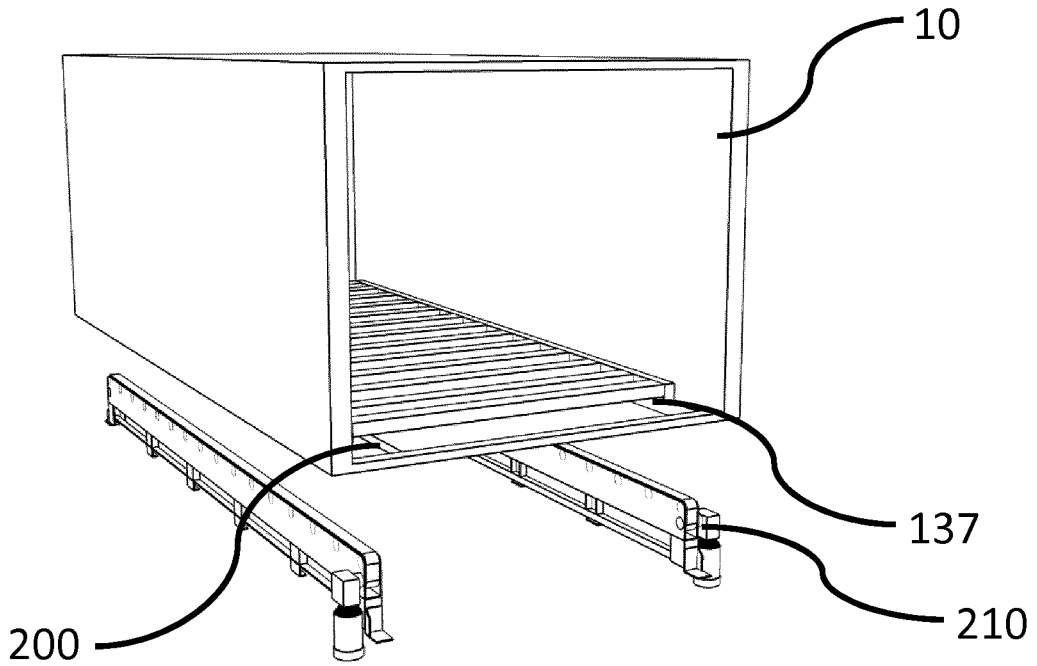
Figure 19:
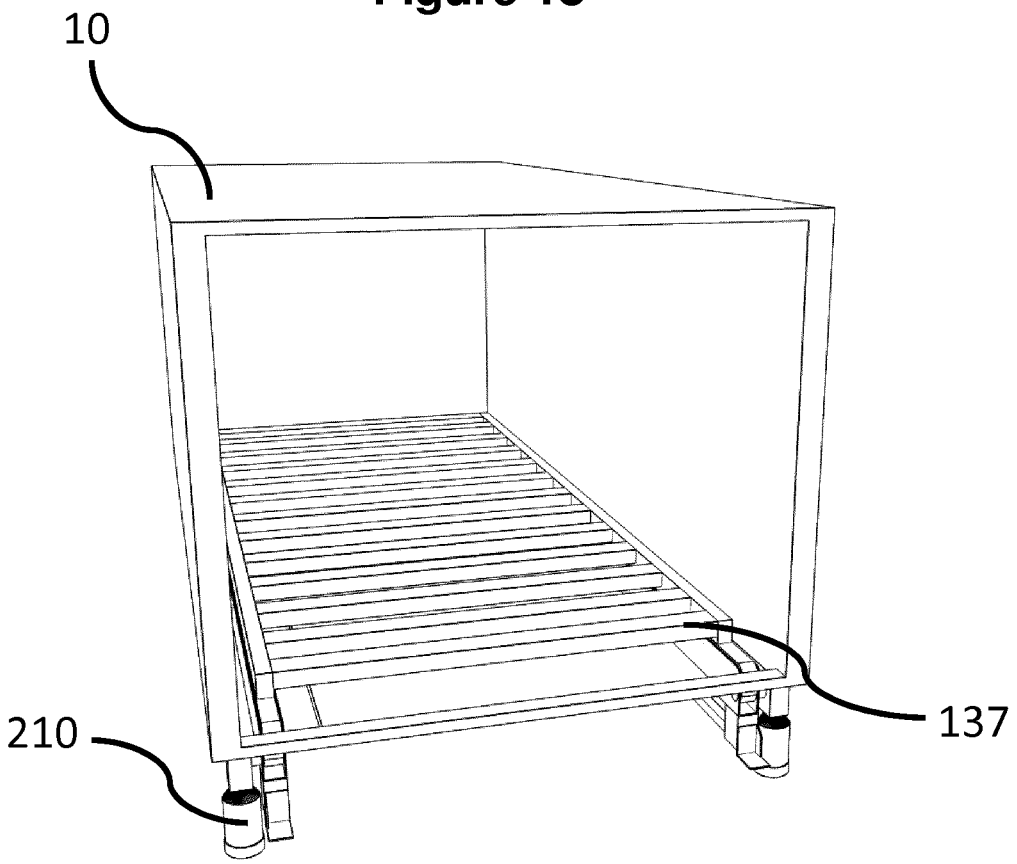
Figure 20:
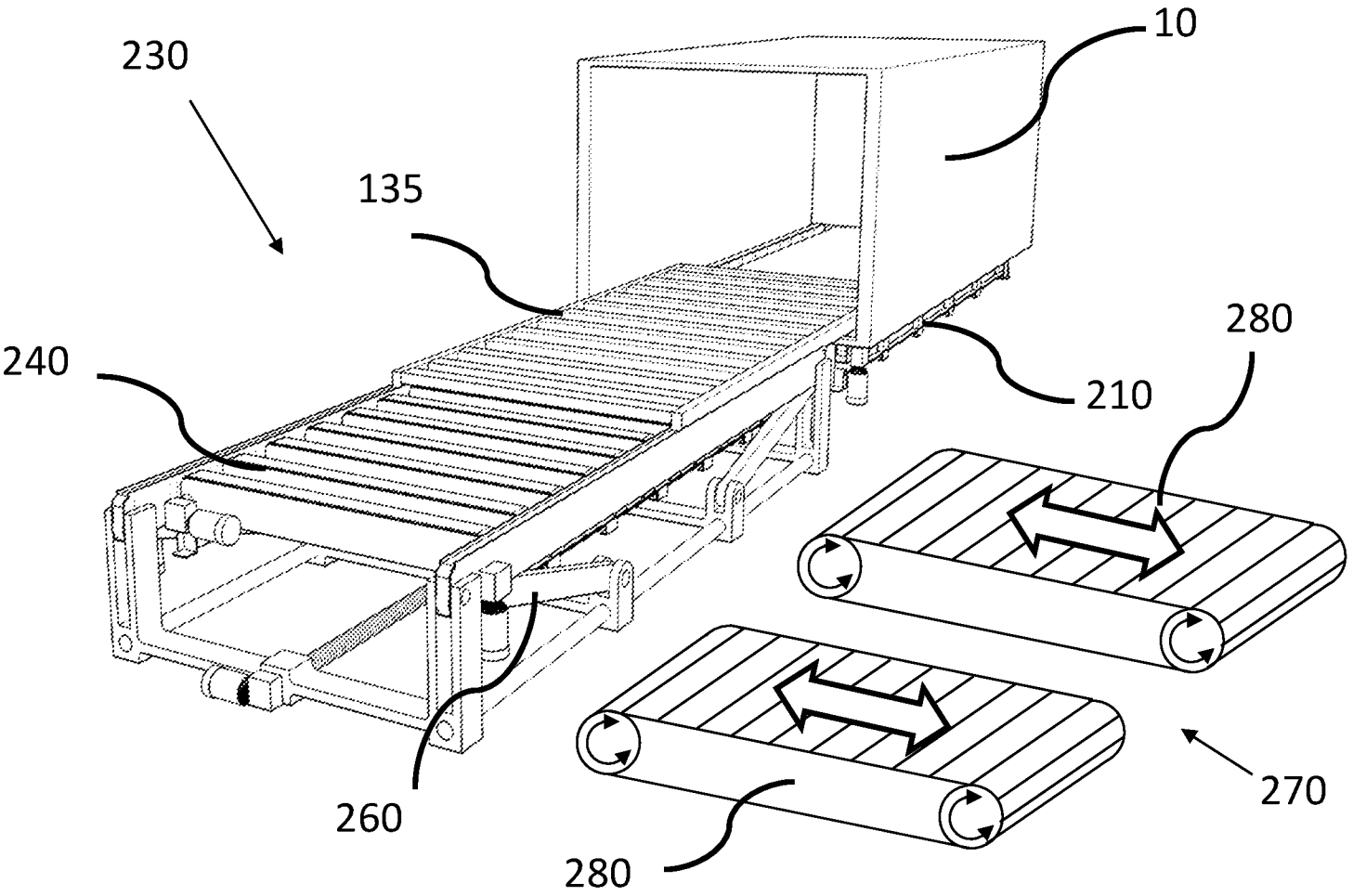
Figure 21:
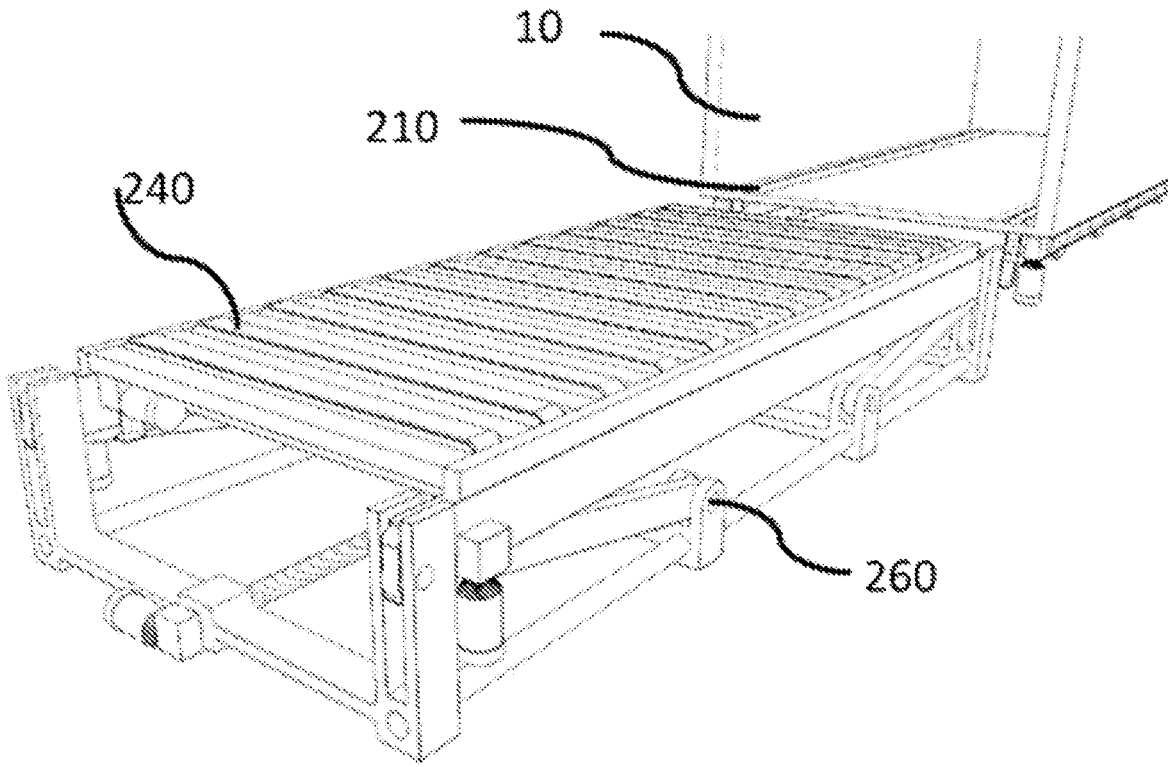

FIG. 5 shows a schematic perspective view of a robotic parking system, the system comprising containers of different sizes capable of carrying different sizes of vehicle within stacks;

FIG. 6 shows a schematic perspective view of the robotic parking system, the system comprising two different subsystems for different sizes of containers with different sized robotic load handlers;

FIG. 7 shows a schematic perspective view of an exit station of the system, two of the corner supports and the side barriers being folded down to allow entry of a driver in to the vehicle and to allow the vehicle to exit the device;

FIG. 8 shows a schematic perspective view of a combined entry/exit station of the robotic parking system where both short sides fold down to allow entry and exit of a vehicle in to or out of the system;

FIG. 9 shows a schematic drawing of a portion of the robotic parking system, the system comprising a load handling device, comprising a body and sets of wheels and, lowering a box-type structure in to an entry point with a detachable base to allow loading of the vehicle;

FIG. 10 shows a schematic drawing of the embodiment in FIG. 9, where the box-type structure is connected to the base to form a container, in position to be lifted by the load handling device;

FIG. 11 shows a schematic drawing of the system of FIGS. 9 to 10 showing the container, comprising the box-type structure attached to the base and containing the vehicle, being lifted by the load handling device into the parking structure shown in FIG. 4;

FIG. 12 shows an alternative form of the robotic parking system, the system comprising a plate on which the vehicle is located prior to parking, the plate moving from a first position, where the driver and passengers can exit the vehicle safely, to a second position where the vehicle is located within a container for collection by a load handling device and for transport of the container in to the robotic parking system;

FIGS. 13*a*, 13*b*, and 13*c* showing possible positions of the plate without the vehicle in situ for clarity;

FIGS. 14*a* and 14*b* show a schematic perspective view of one form of entry system for a vehicle, the system comprising an airlock type mechanism to ensure safety of users of the system;

FIG. 15 is a schematic perspective view of one form of robotic parking system showing all aspects of the system described above in use;

FIG. 16 shows a container for a robotic parking system in accordance with one form of the invention, the container comprising slots in the base;

FIG. 17 shows an underneath view of the container of FIG. 16;

FIG. 18 shows a schematic perspective view of one form of the invention, showing the container of FIGS. 16 and 17 together with conveyor means, the conveyor means being sized so as to protrude through the slots in the container and engage with a vehicle carrying plate located within the container;

FIG. 19 shows the container of FIG. 18 with the conveyor means protruding through the slots in the container;

FIG. 20 shows a vehicle alignment mechanism in accordance with one form of the invention, the vehicle alignment mechanism comprising moveable belt means positioned adjacent the container of FIGS. 16 to 19, the plate of the system being moveable from within the container to above the moveable belts; and FIG. 21 shows the plate in position on the vehicle alignment mechanism, the plate having been lowered by lift means such that the moveable belt means protrude through slots in the plate.

FIG. 1 shows a stackable container 10, the container 10 carrying a vehicle 20. The container 10 comprises 4 corner supports 30, a container base 35 and side barriers 40. The corner supports are moveable around a pivot point at the join with the base 35 such that the corner supports can fold down, as shown in FIG. 2, to allow easy movement and positioning of the vehicle 20 within the container 10. As shown in FIG. 3, the side barriers 40 are collapsible to allow easy entry in to the vehicle 20 from the container 10.

It will be appreciated that the word "container" is used here for a device which is primarily a platform with four heavy corner uprights 30 to support other containers 10 on top and sidings 40 especially on the short sides to ensure a vehicle 20 can never roll off the container 10 or any person accidentally left inside a vehicle 20 can get out of the vehicle 20 and in to danger. However it will be appreciated that the container 10 may be of any suitable form that is capable of carrying a vehicle 20 and supporting other containers 10 carrying vehicles 20 in a stack 110.

For example, in another embodiment of the invention the container 10 may comprise a platform having lowerable upturned sides and a cage or box structure that may be lowered over the vehicle 20, thereby completely enclosing the vehicle which may be advantageous for safety reasons.

In use, a plurality of containers are stacked on top of one another to form stacks 110. The stacks 110 are arranged within a frame structure 70. FIG. 4 shows stacks 110 each comprising five containers 10, the device 100 comprising a 6 by 3 block of stacks 110 within the frame structure 70. The frame structure 70 comprises a series of upright members 72 that support horizontal members 74*a*, 74*b*. A first set of substantially parallel horizontal members 74*a* is arranged substantially perpendicularly to a second set 74*b* of substantially parallel horizontal members to form a horizontal grid structure 74 supported by the upright members 72.

The members 72, 74 are typically manufactured from metal. The containers 10 are stacked between the members 72, 74 of the frame structure 70, such that the frame structure 70 guards against horizontal movement of the stacks 110 of containers 10, and guides vertical movement of the containers 10.

The top level of the frame structure 70 includes rails 74 arranged in a grid pattern across the top of the stacks 110. Referring to FIGS. 4, 5 and 6, the rails 74 support a plurality of robotic load handling devices 50. A first set 74*a* of parallel rails 74 guide movement of the load handling devices 50 in a first direction (X) across the top of the frame structure 70, and a second set 74*b* of parallel rails 74, arranged substantially perpendicular to the first set 74*a*, guide movement of the load handling devices 50 in a second direction (Y), substantially perpendicular to the first direction. In this way, the rails 74 allow movement of the load handling devices 50 in two dimensions in the X-Y plane, so that a load handling device 50 can be moved into position above any of the stacks 110.

Each load handling device 50 comprises a body 55 which is arranged to travel in the X and Y directions on the rails 74 of the frame structure 70, above the stacks 110. A first set of wheels 34, consisting of a pair of wheels 34 on the front of the body 55 and a pair of wheels 34 on the back of the body 55, are arranged to engage with two adjacent rails of the first set 74*a* of rails 74. Similarly, a second set of wheels 36, consisting of a pair of wheels 36 on each side of the body 55, are arranged to engage with two adjacent rails of the second set 74*b* of rails 74. Each set of wheels 34, 36 can be lifted and lowered, so that either the first set of wheels 34 or the second set of wheels 36 is engaged with the respective set of rails 74*a*, 74*b* at any one time.

When the first set of wheels 34 is engaged with the first set of rails 74*a* and the second set of wheels 36 are lifted clear from the rails 74, the wheels 34 can be driven, by way of a drive mechanism (not shown) housed in the body 55, to move the load handling device 50 in the X direction. To move the load handling device 50 in the Y direction, the first set of wheels 34 are lifted clear of the rails 74, and the second set of wheels 36 are lowered into engagement with the second set of rails 74*b*. The drive mechanism can then be used to drive the second set of wheels 36 to achieve movement in the Y direction.

In this way, one or more robotic load handling devices 50 can move around the grid at the top of the stacks 110 on the frame structure 70 under the control of a central picking system (not shown). Each robotic load handling device 50 is provided with means for lifting out one or more containers 10 from the stack 110 to access the required vehicle. Using multiple load handling devices 50 enables access vehicles 20 from multiple locations in the grid and stacks 110 at any one time.

In use, a vehicle 20 is manoeuvred into a container 10 at an entry point and the driver exits the vehicle 20. The corner supports 30 and side barriers 40 are raised and a load handling device 50 is instructed by a control system (not shown) to collect the container 10 and position it within the stacks 110 of containers 10. The control system decides on the optimal point the vehicle should be positioned in the stacks 110. If the vehicle 20 is not required for a long period of time, it may be advantageous for the container 10 to be laced underneath containers 10 holding vehicles 20 that are needed more imminently. Therefore, the load handler 50 may move containers 10 already in the stacks 110 in order to create a position to place the container 10 holding the new vehicle 20 to be parked. Once a suitable position is created, the load handler 50 is positioned on the grid 74 at a point where it can pick up the container 10. The container 10 is lifted to within the body 55 of the load handler 50 and the load handler 50 is moved to a position on the grid 74 immediately above the position where the container is to be placed in a stack 110. If necessary, other containers 10 are back placed above the recently positioned container 10.

It will be appreciated that several load handlers 50 may need to work in cooperation to move containers 10 around in the stacks 110. Furthermore, load handlers may rearrange the stacks periodically in order to position vehicles 20 near the tops of the stacks 110 that will be needed soonest.

When a vehicle 20 needs to be retrieved from the stacks 110, a load handler 50 is positioned above the relevant stack 110 and removes the top container 10. If this container 10 holds the desired vehicle 20, the container 10 is moved to the exit point. If the container 10 does not contain the desired vehicle 20, the container is moved to an alternative stack 110 and the next container in the first stack 110 is accessed. This continues until the container 10 holding the desired vehicle 20 is retrieved. This container 10 is then moved to the exit point for collection.

In this way, a high density of vehicle packing is achieved, whilst easy deposit and retrieval of vehicles is maintained.

It will be appreciated that a control system, not shown, is provided with suitable means for identifying and monitoring which vehicle 20 is in which container and where in the stacks 110 it is located. The control means may use number plate recognition or may use a ticketing and bar coding system or any other suitable tracking means It will be appreciated that there is a grid structure to support the containers 10 horizontally. This means that the containers 10 can be designed for the corner supports 30 to take the vertical forces from the containers above, but do not need to take any horizontal forces. This way highly stable stacks 110 can be made from low cost containers 10.

It will be appreciated that vehicles 20 will be loaded into and out of containers 10 at dedicated entry and exit points. Examples of these entry and exit points are shown in FIGS. 7 and 8. As shown in FIGS. 7 and 8, the entry and/or exit points comprise an area where the container 10 is received from the load handling device 50. The entry and/or exit point may comprise additional barriers or fencing to protect users when the container 10 is being received from the load handling device 50.

In a further example, the container 10 has one or two folding short sides incorporating the corner supports, which can be used as ramps to drive on and off, but will also allow the container to be as narrow as possible, since the vehicle will not need to be driven in between the load carrying pillars at the corners.

In yet another example of the robotic parking system, the long sides of the container are arranged so that they enable driver and passengers to open the doors at entry and exit stations, when either of the short sides are down. When the short sides are up, the long sides will provide a barrier, so that no doors can be opened. This to prevent a person who accidentally gets left inside a vehicle from getting into danger.

In a further example, there is a heat or other sensor to ensure that no person or animal is left inside the vehicle before the container is closed.

In a further example the driver of the vehicle 20 communicate with the parking system via a communication device such as a smartphone to set and modify the time to access the vehicle.

In yet another example, the driver can specify a certain airplane or train on which he is travelling, and the parking control system can communicate with the air or train traffic control systems to estimate when the vehicle will be required.

In another example, the priority of different drivers waiting for their vehicles can be set depending on how much they pay for the parking.

In a further example, there are containers 10 of different heights and/or sizes to maximise space utilisation when there are vehicles of significantly different heights.

In another example, there are two or more sizes of containers and load handlers for situations where a significant proportion of the vehicles are substantially smaller than others, the stacks 110 being arranged such that there are subsections of the system dedicated to differently sized vehicles.

In a final example, automatic number plate recognition is used at the entry to the facility to get information about the model of vehicle, so that the driver can be directed to an appropriate entry station.

It will be appreciated that as each container supports the container 10 above it in the stack 110 each container 10 must be able to support the weight of the maximum number of containers 10 when fully laden with vehicles 20 that may be held in the stack 110. It is therefore important that the structure of the container is designed to accommodate such vertical forces.

In the examples described above, the container 10 comprises structural corner supports 30 mounted on a flat base 35. However, it will be appreciated that any suitable form of container 10 may be used that is capable of supporting laden containers 10 in the stack 110 above it.

As shown in FIGS. 9 to 11, the container 11 comprises a platform 35 and a box-type lid structure 80. It will be appreciated that in this embodiment, the box-type structure 80 would need to be able to support similarly configured containers 11 above it in the stack 110. This may require solid sides to be used for the box structure 80 or may require corner supports 30 to be used with a cage like box structure mounted thereon.

In use, the vehicle 20 is parked on the substantially flat base 35. Once the driver and any passengers have exited the vehicle 20, a box-like structure is lowered over the vehicle. The box-like structure 80 comprises four load carrying supports 30 in the corners and solid and/or mesh sides and roof, as required for stability and protection. The box-type structure 80 is removably attached to the base 35 in order to allow the container 11 to be moved within the parking system. The container 11, base 35 and box-type structure may be formed from steel, either solid sheets or mesh either in total or in combination. However, it will be appreciated that any suitable material may be used.

As shown in FIGS. 12 to 14, an alternative mechanism for inputting vehicles in to the robotic parking system is shown.

As shown in FIG. 12, the alternative mechanism comprises a plate moveable mounted on a set of rollers 100. The plate 135 may be moved from a first position to a second position on the rollers 100. The rollers 100 may be driven by an appropriate driving mechanism. In the first position, the plate 135 is positioned such that a vehicle may be located thereon. In the second position, the plate 135 is positioned within a box-type structure 180 comprising at least corner supports. The box type structure 180 may comprise sides formed from a solid panel or a mesh type structure formed from any suitable material but preferably a structural metallic material. Preferably the box-type structure comprises solid sides so as to protect the robotic parking system, other vehicles and operatives, from fire within the box once the vehicle is parked.

The roller mechanism 100 within the box 180 is provided with rollerless recesses. The underside of the plate 135 is provided with cooperating means to interact with the rollerless recesses in the base of the box 180.

The plate 135, when in the second position within the box-type structure locates in recesses within the roller mechanisms 100 in the base of the box. The recesses within the roller mechanism 100 enable the plate 135 to releasably locate at a fixed position within the box 180. Furthermore, the weight of any vehicle on the plate 135 will cause the plate 135 to locate in such a manner that the vehicle cannot move once the box 180 is lifted by the load handling device 50.

The mechanism by which the plate 135 and the roller mechanism interact is more clearly shown in FIGS. 13*a* to 13*c*. FIG. 13*a* shows the plate 135 in the second position in which the plate is fully located within the box 180 and securely positioned. FIG. 13*b* shows in greater detail the recesses in the roller system 100 that allows the plate 135 to correctly move and and repeatedly locate in a secure position within the box 180.

FIG. 13*c* shows the plate 135 in the second position where the again the plate 135 is entirely within the box and the underside of the plate 135 is located such that the rollerless recesses in the base of the box 185 are located against cooperating portions of the plate 135.

As shown in FIG. 15, the density of parking achieved by the robotic parking system exceeds that of a standard multi storey car park as no entry and exit ramps or aisles are required.

In use, as shown in FIG. 14, a vehicle 20 enters through an open gate in to an entry point. The vehicle 20 is positioned on the plate 135, the plate 135 being located on the roller mechanism in the first position. Doors 192 to the parking system are closed. The driver and passengers exit the vehicle and the system through the doors 190. Once the doors 190 are closed, the doors 192 may open and the roller mechanism activates to move the vehicle located on the plate 135 in to the box 180. The plate 135 is driven on the rollers via any suitable drive system until the plate locates in the rollerless recesses in the base of the box 180. At this point the plate 135 will no longer move with respect to the box 180 and the vehicle is correctly and securely positioned within the box 180.

Once in the second position within the box, the door 192 will shut and the plate 135 will be substantially sealed against the base of the box 180. In this way, should there be any ignition of fuel within the box, no adjacent vehicles will be damaged and the fire may be contained within one box 180.

Once the box 180 is sealed the load handling device will be moved in situ and the box containing the vehicle will be lifted and positioned within a stack within the parking system. It will be appreciated that the box can be identified by suitable identification means and that the box 180 may be positioned with the stacks dependent on the length of time the vehicle is expected to remain within the car park.

In order to remove the car from the car park, the position of the box containing the target vehicle is identified and the load handling devices, either individually or in concert act so as to retrieve the target box 180 from within a stack within the system. Once retrieved by a load handling device 50, the box is returned to the entry/exit point of the car park where the box is deposited in the exit area. Once the doors 192 are opened, the roller mechanism acts in reverse to move the plate 135 from the second position within the box to the first position where the vehicle can be collected. Once in the first position, the door 192 closes and the driver can enter and retrieve the vehicle.

It will be appreciated that the plate 135 will need to be lifted so as to overcome the secured positioning of the plate 135 within the rollerless recesses within the box 180. This may be achieved by any suitable means but these may include providing a lifting mechanism operable to lift the plate 135 only once the box is located fully in the exit position.

Once in the exit position with the door 192 closed, the door 190 may open to allow the vehicle to exit.

Each box 180 may be provided with sprinkler means to extinguish any fire in the event of an emergency. It will be appreciated that the water or fire retardant fluid may be routed in to the box 180 via pipework mounted on or within the uprights 72 of the framework or the horizontal structural members 74. When not in use, the sprinkler pipes remain empty. In this way, leakage of water or fire retardant fluid is minimised.

When located within the box 180, the plate 135 may define a cavity enabling liquids such as oil, rain water and melted snow plus other road debris may collect in the cavity. The cavity will be sealed such that no liquids or debris leak on to vehicles or boxes 180 below. Furthermore, the cavity may be periodically cleaned in response to a signal from sensor means located within the cavity indicating that cleaning is required.

In the event of a fire being detected, only the boxes 180 in the given stack or the individual container containing the fire need be sprinkled. The box type structure may be sealed sufficiently to prevent the spread of fire due to lack of oxygen.

Other services may be routed to boxes in a similar manner. For example sensors may be located within the boxes 180 to monitor temperature, humidity, vibration, movement. Furthermore, camera means may be provided within each box to allow the car park operator to monitor the vehicles contained within the stack. All of these sensor mechanisms require power and may require data logging means. All such services and communication means may be routed to each box 180 via the uprights 72 of the framework or may be routed via the boxes 180 themselves.

UK Patent Application Nos GB1518091.2 and GB1518115.9, detail systems and methods of routing services through containers and framework structures and are hereby incorporated by reference.

It will be appreciated that the load handling devices 50 must be capable of lifting and moving laden containers. However, any suitable form of winch mechanism capable of lifting a laden container 10, 11 up and within the body 55 of the load handler 50 may be used.

In accordance with a first aspect of the invention, the vehicles may be aligned and positioned for presentation to the system by an input system for accurately positioning and inputting vehicles in to containers of the car parking system as described below with reference to FIGS. 16 to 21

From FIGS. 16 to 21 it can be seen the input mechanism comprises conveyor means 210, a plate 135 which may be the plate described above with reference to the system as a whole, an alignment bay external to the stacks of the robotic parking system and an alignment mechanism 230 for accurately positioning a vehicle on the plate 135 such that said plate 135 may be moved in to the container, box or cage 10 or moved out of the container, box or cage 10 in a controlled manner.

The container, box and or cage 10 comprises two longitudinal slots 200 in the base. The slots 200 preferably run approximately parallel to the long axis of the container 10 although the short axis may also be envisaged as an alternative depending on the orientation of loading and unloading the vehicle. The plate 135 is moveably located on the floor of the container 10 protruding over the slots, as shown in FIG. 17. As can be seen from the Figures, the plate 135 comprises a substantially planar, slotted, carrying portion 137 on which a vehicle can be positioned. However, it will be appreciated that as described below the plate 135 may take any suitable form.

The input mechanism further comprises conveyor means 210 sized so as to cooperate with the slots 200 in the base of the container 10 and protrude therethrough. On protruding through the slots 200, the conveyor means 210 act so as to lift the plate 135 above the level of the base of the container 10.

The input mechanism further comprises an alignment bay located adjacent the robotic parking system and with access for the plate 135, 137 to be moved from a first position in the alignment bay to a second position within the container, box or cage 10, with or without a vehicle located thereon.

The alignment bay further comprises an alignment mechanism 230, one form of the alignment mechanism 230 in accordance with the invention being shown in detail in FIGS. 18 to 21.

The alignment mechanism 230 comprises first moveable belt means 240 positioned adjacent the container, box or cage 10 and capable of having the plate 135 located thereabove. The alignment mechanism 230 further comprises second moveable belt means 250 both first 240 and second moveable belt means 250 being positioned substantially perpendicularly to the conveyor means 210 and the long axis of the plate 135 and container, box or cage 10.

The plate 135, as described above comprises slots positioned so as to cooperate with the first moveable belt means 240. The first moveable belt means 240 when the plate 137 is in a first lower position, protrude through at least some of the slots in the plate 137. It will be appreciated that the plate 137 may comprise only sufficient slots through which the first belt means may protrude or alternatively, the plate 135 may comprise multiple slots through which the first moveable belt means 240 may protrude.

The plate 135, 137 may be raised and lowered by suitable lift means 260 from a first position where the first moveable belt means 240 protrude through the slots in the plate 135 to a second position where the plate 135 is lifted clear above the first moveable belt means 240.

The lift means 260 may comprise any form of motorised lift capable of moving the plate 135 with or without a vehicle located thereon, clear of the first moveable belt means 240.

The conveyor means 210 are located so as to move the plate 135, once in a raised position, from a first position above the first moveable belt means 240 to a position within the container, box or cage 10.

The alignment mechanism 230 further comprises the second moveable belt means 250. The second moveable belt means 250 acts as a transfer mechanism 270 so as to align and transfer a delivered vehicle with and on to the plate 135, 137. Such alignment is required to ensure accurate positioning of the vehicle in the container, box or cage 10. In one form of the invention, the second moveable belt means 250 comprises two large belts 280 on which a vehicle may be parked. The belts 280 may be independently rotated and moved with respect to each other.

It will be appreciated that the transfer mechanism 270 may form part of an alignment bay 220 or may be positioned immediately adjacent the alignment mechanism 230. The transfer mechanism 270 comprises means for transferring a delivered vehicle on to the alignment mechanism 230 in a timely and efficient manner. It will be appreciated that the transfer mechanism 270 may comprise further motorised belt means, or a moveable plate on belt means or any other mechanism suitable for moving the delivered vehicle from the drop off zone on to the alignment mechanism 230.

In use, the vehicle is parked on the second moveable belt means 250 of the transfer mechanism 270, with the front wheels of the vehicle on one belt 280 and rear wheels of the vehicle on the second belt 280. The two belts 280 are moved with respect to each other until the long axis of the vehicle is aligned so as to be substantially parallel with the long axis of the plate 135 and hence the container, box or cage 135.

A control utility is provided using vision systems, detection systems or other alignment systems to ensure correct alignment of the vehicle on the transfer mechanism 270.

Once this position is achieved, the two belts 280 of the transfer mechanism 270 are moved in concert so as to move the vehicle in a sideways direction on to the first belt means 240 that are protruding through the suitably positioned cooperating slots in the plate 135. The first moveable belt means 240 are then activated so as to move the vehicle completely on to the plate 135.

Once the vehicle is positioned fully on the first moveable belt means 240 the plate 135 is lifted by the lift means 260 such that the plate is completely clear of the first moveable belt means 240 but level with the base of the container, box or cage 10.

Once this position of plate 135 and vehicle is achieved, the conveyor means 210 acts so as to move the plate 135 relative to the container, box or cage 10 in a manner whereby the plate 135 may be moved in to the container or box 10. It will be appreciated that the method described above may be used in reverse to remove a vehicle from a container, box or cage 10. Indeed, it will be appreciated that in this way, it is possible given the above mechanism to move the plate 135 out of the box or container 10 even though the container, box or cage 10 and the plate 135 has no moving parts.

It will be appreciated that the it is possible using the above described mechanism to move vehicles on to and off the plate 135 in a sideways direction, substantially perpendicular to the long axis of the plate 135 thereby straightening and aligning a vehicle on the plate prior to insertion of the plate in to the container, box or cage 10.

It will be appreciated that the mechanisms described above are exemplary only and a skilled person in the art may be able to propose alternative mechanisms.

The invention claimed is:

1. An alignment mechanism for a robotic parking system, comprising:

containers configured to receive vehicles, the alignment mechanism including:

a vehicle carrying plate configured to be moveable from a first position adjacent a container to a second position within a container, the mechanism including:

a transfer mechanism configured for transferring a vehicle from a drop off location adjacent the parking system to the plate, the transfer mechanism including moving means for moving the vehicle on to the vehicle carrying plate, the moving means including:

a first moving means configured for moving relative to a second moving means when front wheels of a vehicle are positioned on the first moving means, and rear wheels of the vehicle are placed on the second moving means such that a long axis of a vehicle will be moved so as to be substantially parallel to a long axis of the plate.

2. An alignment mechanism for a robotic parking system according to claim 1, comprising:

conveyor means for moving the plate from a first position adjacent the container to a second position within the container, the conveyor means including means separate from at least one of the container or the plate to ensure neither the container nor the plate include the moving means.

3. A method of aligning a vehicle for input in to a robotic parking system having vehicle holding containers, the method comprising:

delivering a vehicle to a drop off location adjacent the robotic parking system;

positioning the vehicle to be parked on alignment means;

moving the alignment means such that a first axis of the vehicle is substantially parallel to one axis of a vehicle holding container;

transferring the vehicle on to a vehicle holding plate; and moving the vehicle holding plate in a direction parallel to the first axis of the vehicle in to the vehicle holding container.

* * * * *